US010443019B2

(12) United States Patent
Fossum et al.

(10) Patent No.: US 10,443,019 B2
(45) Date of Patent: Oct. 15, 2019

(54) DETERGENT COMPOSITION COMPRISING TERNARY SURFACTANT MIXTURE, ENCAPSULATES, AND CATIONIC POLYMER DEPOSITION AID

(71) Applicant: The Procter & Gamble Company, Cincinnati, OH (US)

(72) Inventors: Renae Dianna Fossum, Middletown, OH (US); Gregory Thomas Applegate, Cincinnati, OH (US); Anne Compton Rodrigue, Hyde Park, OH (US); Lon Montgomery Gray, Florence, KY (US); Kristi Lynn Fliter, Harrison, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 80 days.

(21) Appl. No.: 15/590,077

(22) Filed: May 9, 2017

(65) Prior Publication Data

US 2017/0335237 A1 Nov. 23, 2017

Related U.S. Application Data

(60) Provisional application No. 62/339,118, filed on May 20, 2016.

(51) Int. Cl.

| | |
|---|---|
| ***C11D 1/83*** | (2006.01) |
| ***C11D 1/00*** | (2006.01) |
| ***C11D 3/37*** | (2006.01) |
| ***C11D 3/50*** | (2006.01) |
| ***C11D 10/04*** | (2006.01) |
| ***C11D 11/00*** | (2006.01) |
| ***C11D 17/00*** | (2006.01) |
| ***C11D 1/655*** | (2006.01) |
| ***C11D 3/20*** | (2006.01) |
| ***C11D 3/22*** | (2006.01) |
| ***C11D 17/04*** | (2006.01) |
| *C11D 1/12* | (2006.01) |

(52) U.S. Cl.

CPC ..... *C11D 1/002* (2013.01); *C11D 1/655* (2013.01); *C11D 1/83* (2013.01); *C11D 3/2093* (2013.01); *C11D 3/227* (2013.01); *C11D 3/3765* (2013.01); *C11D 3/3773* (2013.01); *C11D 3/3776* (2013.01); *C11D 3/505* (2013.01); *C11D 10/04* (2013.01); *C11D 11/0017* (2013.01); *C11D 17/0013* (2013.01); *C11D 17/0026* (2013.01); *C11D 17/0039* (2013.01); *C11D 17/043* (2013.01); *C11D 1/12* (2013.01)

(58) Field of Classification Search

CPC .... C11D 1/83; C11D 1/29; C11D 1/22; C11D 3/001; C11D 3/38645; C11D 3/505

See application file for complete search history.

(56) References Cited

U.S. PATENT DOCUMENTS

| | | | | |
|---|---|---|---|---|
| 7,968,510 | B2 | 6/2011 | Smets et al. | |
| 8,759,275 | B2 | 6/2014 | Smets et al. | |
| 2015/0057212 | A1 | 2/2015 | Hulskotter et al. | |
| 2015/0099680 | A1 | 4/2015 | Smets et al. | |
| 2015/0275136 | A1* | 10/2015 | Si | C08F 220/56 510/341 |
| 2015/0376550 | A1* | 12/2015 | Ohtani | C11D 3/505 510/296 |
| 2016/0040104 | A1 | 2/2016 | Liu et al. | |
| 2016/0060570 | A1 | 3/2016 | Panandiker et al. | |
| 2016/0060571 | A1 | 3/2016 | Panandiker et al. | |
| 2016/0060572 | A1 | 3/2016 | Panandiker et al. | |
| 2016/0060573 | A1 | 3/2016 | Fossum et al. | |
| 2016/0060575 | A1 | 3/2016 | Panandiker et al. | |
| 2016/0090551 | A1* | 3/2016 | Fossum | C11D 1/16 8/137 |

FOREIGN PATENT DOCUMENTS

WO WO 2015/144053 A1 10/2015

OTHER PUBLICATIONS

PCT International Search Report for application No. PCT/US2017/033009, dated Jul. 25, 2017, 11 pages.
PCT International Search Report for application No. PCT/US2017/033010, dated Jul. 25, 2017, 12 pages.
PCT International Search Report for application No. PCT/US2017/031524, dated Jul. 27, 2017, 30 pages.
EP Search Report for application No. 11188595.0-1221, dated Jan. 17, 2012, 12 pages.
PCT International Search Report for application No. PCT/US2010/055393, dated Feb. 23, 2011, 5 pages.
PCT International Search Report for application No. PCT/US2015/1046627, dated Nov. 24, 2015, 11 pages.
PCT International Search Report for application No. PCT/US2015/046628, dated Nov. 26, 2015, 11 pages.
PCT International Search Report for application No. PCT/US2015/046629, dated Nov. 10, 2015, 11 pages.
U.S. Appl. No. 15/159,840, filed May 20, 2016, Renae Dianna.
U.S. Appl. No. 15/159,846, filed May 20, 2016, Gregory Thomas Applegate.

* cited by examiner

*Primary Examiner* — Charles I Boyer
(74) *Attorney, Agent, or Firm* — Andres E. Velarde; Gregory S. Darley-Emerson

(57) ABSTRACT

Detergent compositions that include surfactant systems, encapsulates, and cationic deposition aid polymers. Methods of making and using such compositions.

23 Claims, 2 Drawing Sheets

DETERGENT COMPOSITION COMPRISING TERNARY SURFACTANT MIXTURE, ENCAPSULATES, AND CATIONIC POLYMER DEPOSITION AID

FIELD OF THE INVENTION

The present disclosure relates to detergent compositions that include surfactant systems, encapsulates, and cationic deposition aid polymers. The present disclosure further relates to methods of making and using such compositions.

BACKGROUND OF THE INVENTION

When washing clothes, consumers often want the fabric to come out looking clean and having other benefits, such as freshness. Conventional detergents may not have the desired benefits that consumers want since they are designed to remove soils and stains from the fabric, and may not effectively deposit other benefit agents onto the fabrics. Cationic deposition polymers can be used to increase deposition efficiency of benefit agents onto fabrics. However, it has been found that conventional detergents that comprise traditional deposition polymers, which typically have a high molecular weight, do not clean or maintain whiteness benefits as well as conventional detergents that do not contain the cationic deposition polymers. Traditional cationic deposition polymers deposit not just benefit agents, but also soils from the wash water onto fabric, resulting in dingy fabrics and/or losses on stain removal benefits. For example, traditional cationic polymers can flocculate clay, since the cationic polymers interact with the anionic surfactants in the detergent, leading to clay re-deposition.

Another aspect to providing cleaning in the presence of polymer deposition aids is the use of enzymes. Commercially available enzymes may contain trace amounts of cellulase, up to 1% of the enzyme, even though cellulase is not the predominant or target enzyme in the enzyme mixture. Therefore, the detergent compositions of the present disclosure may comprise cellulase, for example at trace levels, such as present at levels of up to 0.005 wt %, by weight of the composition. Typically, cellulase is not compatible with cellulosic-/polysaccharide-based molecules, such as certain cationic polysaccharide polymers, such as cationic hydroxyethyl cellulose. If cellulase impurities are present, the cationic hydroxyethyl cellulose polymers are acted upon by the enzyme rendering them ineffective as deposition aids. Removing trace amounts of cellulase from protease mixtures to be compatible with cationic hydroxyethyl cellulose results in higher enzyme costs, and makes it difficult during processing to re-blend detergent compositions containing cellulase impurities with detergent compositions containing cationic hydroxyethyl cellulose to avoid waste.

Therefore, there is a need for a detergent that provides both good stain removal and good freshness benefits.

SUMMARY OF THE INVENTION

The present disclosure relates to liquid detergent compositions that include a surfactant system, encapsulates, and cationic deposition aid polymers.

The present disclosure relates to liquid detergent compositions that include a surfactant system, encapsulates, and a cationic deposition aid polymer, where the detergent composition includes from about 8% to about 50%, by weight of the detergent composition, of the surfactant system, where the surfactant system includes anionic surfactant and nonionic surfactant present in a weight ratio of from about 1:1 to about 4.5:1, where the anionic surfactant includes an anionic sulphate surfactant and an anionic sulphonate surfactant in a weight ratio of from about 1:1 to about 20:1, where the detergent composition includes from about 0.1% to about 5%, by weight of the detergent composition, of the encapsulates, where the encapsulates include a core and a wall at least partially surrounding the core, where the core includes a benefit agent, where the cationic deposition aid polymer is a non-polysaccharide polymer and is characterized by a weight average molecular weight of from about 5 to about 200 kDaltons, and where the liquid detergent composition contains, if any, no more than 0.3% of a silicone.

The present disclosure relates to a liquid detergent composition that includes a surfactant system, encapsulates, and a cationic deposition aid polymer, where the detergent composition includes from about 8% to about 30%, by weight of the detergent composition, of the surfactant system, where the surfactant system includes anionic surfactant and nonionic surfactant present in a weight ratio of from about 1:1 to about 3.8:1, where the detergent composition includes from about 0.1% to about 5%, by weight of the detergent composition, of the encapsulates, where the encapsulates include a core and a wall at least partially surrounding the core, where the core includes a benefit agent, where the cationic deposition aid polymer is a non-polysaccharide polymer and is characterized by a weight average molecular weight of from about 15 to about 50 kDaltons, where the cationic deposition aid polymer includes a cationic structural unit derived from a cationic monomer selected from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof, and where the cationic deposition aid polymer further includes a nonionic structural unit derived from (meth)acrylamide, where the cationic structural unit and the nonionic structural unit are present in the cationic deposition aid polymer in a molar ratio of from about 60:40 to about 85:15, and where the liquid detergent composition contains, if any, no more than 0.3% of a silicone.

The present disclosure also relates to a method of treating a fabric, the method including a washing step, where the washing step includes contacting a fabric with a detergent composition as described herein. The method may further include a softening step, where the washing step includes contacting the fabric with a softening composition.

BRIEF DESCRIPTION OF THE DRAWINGS

The figures herein are illustrative in nature and are not intended to be limiting.

DETAILED DESCRIPTION OF THE INVENTION

Figure 1:
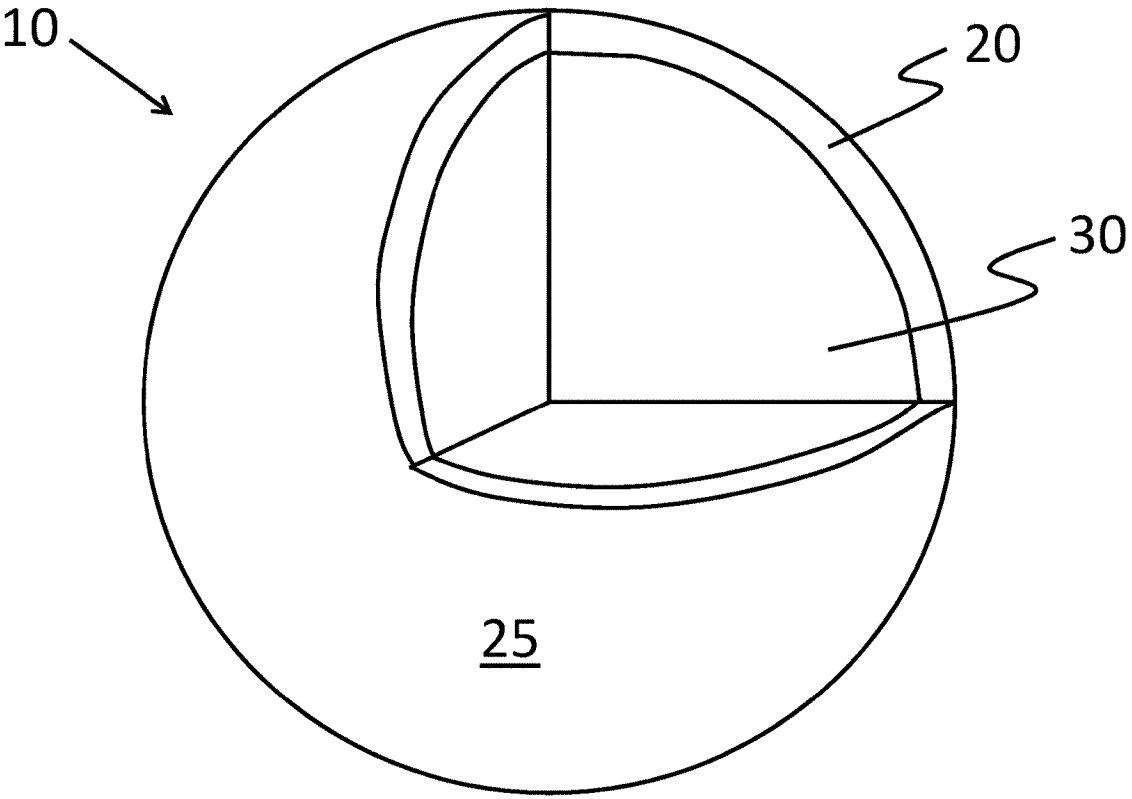
FIG. 1 shows a schematic of an encapsulate 10 according to the present disclosure.

The present disclosure relates to fabric treatment compositions comprising a cationic polymer, encapsulates, and a surfactant system. The fabric care compositions of the present disclosure are intended to deliver both cleaning and/or whiteness benefits as well as freshness and/or encapsulate deposition benefits. These benefits are provided by selecting particular low-molecular-weight cationic deposition polymers and particular surfactant systems for use in encapsulate-comprising compositions.

It has been surprisingly found that by selecting particular combinations of specific low-molecular-weight cationic deposition polymers and particular ratios of surfactants in a surfactant system, it is possible to formulate a detergent composition that provides cleaning and freshness benefits that are compatible with enzyme mixtures containing trace amounts of cellulase. Without wishing to be bound by theory, it is believed that the particular combination of anionic surfactants with the non-ionic surfactants interact with the cationic deposition aid to increase encapsulate retention through the wash process.

The components of the compositions and processes of the present disclosure are described in more detail below.

As used herein, the term "molecular weight" refers to the weight average molecular weight of the polymer chains in a polymer composition. Further, as used herein, the "weight average molecular weight" ("Mw") is calculated using the equation:

$$Mw=(\Sigma i\ Ni\ Mi^2)/(\Sigma i\ Ni\ Mi)$$

where Ni is the number of molecules having a molecular weight Mi. The weight average molecular weight must be measured by the method described in the Test Methods section.

As used herein "mol %" refers to the relative molar percentage of a particular monomeric structural unit in a polymer. It is understood that within the meaning of the present disclosure, the relative molar percentages of all monomeric structural units that are present in the cationic polymer add up to 100 mol %.

As used herein, the term "derived from" refers to monomeric structural unit in a polymer that can be made from a compound or any derivative of such compound, i.e., with one or more substituents. Preferably, such structural unit is made directly from the compound in issue. For example, the term "structural unit derived from (meth)acrylamide" refers to monomeric structural unit in a polymer that can be made from (meth)acrylamide, or any derivative thereof with one or more substituents. Preferably, such structural unit is made directly from (meth)acrylamide. As used herein, the term "(meth)acrylamide" refers to either acrylamide ("Aam") or methacrylamide; (meth)acrylamide is abbreviated herein as "(M)AAm." For another example, the term "structural unit derived from a diallyl dimethyl ammonium salt" refers to monomeric structural unit in a polymer that can be made directly from a diallyl dimethyl ammonium salt (DADMAS), or any derivative thereof with one or more substituents. Preferably, such structural unit is made directly from such diallyl dimethyl ammonium salt. For yet another example, the term "structural unit derived from acrylic acid" refers to monomeric structural unit in a polymer that can be made from acrylic acid (AA), or any derivative thereof with one or more substituents. Preferably, such structural unit is made directly from acrylic acid.

The term "ammonium salt" or "ammonium salts" as used herein refers to various compounds selected from the group consisting of ammonium chloride, ammonium fluoride, ammonium bromide, ammonium iodine, ammonium bisulfate, ammonium alkyl sulfate, ammonium dihydrogen phosphate, ammonium hydrogen alkyl phosphate, ammonium dialkyl phosphate, and the like. For example, the diallyl dimethyl ammonium salts as described herein include, but are not limited to: diallyl dimethyl ammonium chloride (DADMAC), diallyl dimethyl ammonium fluoride, diallyl dimethyl ammonium bromide, diallyl dimethyl ammonium iodine, diallyl dimethyl ammonium bisulfate, diallyl dimethyl ammonium alkyl sulfate, diallyl dimethyl ammonium dihydrogen phosphate, diallyl dimethyl ammonium hydrogen alkyl phosphate, diallyl dimethyl ammonium dialkyl phosphate, and combinations thereof. Preferably but not necessarily, the ammonium salt is ammonium chloride.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

As used herein, the term "cationic polymer" means a polymer having a net cationic charge. Furthermore, it is understood that the cationic polymers described herein are typically synthesized according to known methods from polymer-forming monomers (e.g., (meth)acrylamide monomers, DADMAS monomers, etc.). As used herein, the resulting polymer is considered the "polymerized portion" of the cationic polymer. However, after the synthesis reaction is complete, a portion of the polymer-forming monomers may remain unreacted and/or may form oligomers. As used herein, the unreacted monomers and oligomers are considered the "unpolymerized portion" of the cationic polymer. As used herein, the term "cationic polymer" includes both the polymerized portion and the unpolymerized portion unless stated otherwise. In some aspects the cationic polymer, comprises an unpolymerized portion of the cationic polymer. In some aspects, the cationic polymer comprises less than about 50%, or less than about 35%, or less than about 20%, or less than about 15%, or less than about 10%, or less than about 5%, or less than about 2%, by weight of the cationic polymer, of an unpolymerized portion. The unpolymerized portion may comprise polymer-forming monomers, cationic polymer-forming monomers, or DADMAC monomers, and/or oligomers thereof. In some aspects, the cationic polymer comprises more than about 50%, or more than about 65%, or more than about 80%, or more than about 85%, or more than about 90%, or more than about 95%, or more than about 98%, by weight of the cationic polymer, of a polymerized portion. Furthermore, it is understood that the polymer-forming monomers, once polymerized, may be modified to form polymerized repeat/structural units. For example, polymerized vinyl acetate may be hydrolyzed to form vinyl alcohol.

As used herein, "charge density" refers to the net charge density of the polymer itself and may be different from the monomer feedstock. Charge density for a homopolymer may be calculated by dividing the number of net charges per repeating (structural) unit by the molecular weight of the repeating unit. The positive charges may be located on the backbone of the polymers and/or the side chains of polymers. For some polymers, for example those with amine structural units, the charge density depends on the pH of the carrier. For these polymers, charge density is calculated based on the charge of the monomer at pH of 7. "CCD" refers to cationic charge density, and "ACD" refers to anionic charge density. Typically, the charge is determined with respect to the polymerized structural unit, not necessarily the parent monomer.

As used herein, the term "Cationic Charge Density" (CCD) means the amount of net positive charge present per gram of the polymer. Cationic charge density (in units of equivalents of charge per gram of polymer) may be calculated according to the following equation:

$$CCD = \frac{(Qc \times \text{mol } \%\ c) - (Qa \times \text{mol } \%\ a)}{(\text{mol } \%\ c \times MWc) + (\text{mol } \%\ n \times MWn) + (\text{mol } \%\ a \times MWa)}$$

where: Qc, Qn, and Qa are the molar equivalents of charge of the cationic, nonionic, and anionic repeat units (if any), respectively; Mol % c, mol % n, and mol % a are the molar ratios of the cationic, nonionic, and anionic repeat units (if any), respectively; and MWc, MWn, and MWa are the molecular weights of the cationic, nonionic, and anionic repeat units (if any), respectively. To convert equivalents of charge per gram to milliequivalents of charge per gram (meq/g), multiply equivalents by 1000. If a polymer comprises multiple types of cationic repeat units, multiple types of nonionic repeat units, and/or multiple types of anionic repeat units, one of ordinary skill can adjust the equation accordingly.

By way of example, a cationic homopolymer (molar ratio=100% or 1.00) with a monomer molecular weight of 161.67 g/mol, the CCD is calculated as follows: polymer charge density is (1)×(1.00)/(161.67)×1000=6.19 meq/g. A copolymer with a cationic monomer with a molecular weight of 161.67 and a neutral co-monomer with a molecular weight of 71.079 in a mol ratio of 1:1 is calculated as (1×0.50)/[(0.50×161.67)+(0.50×71.079)]*1000=4.3 meq/g. A terpolymer with a cationic monomer with a molecular weight of 161.67, a neutral co-monomer with a molecular weight of 71.079, and an anionic co-monomer with a neutralized molecular weight of 94.04 g/mol in a mol ratio of 80.8:15.4:3.8 has a cationic charge density of 5.3 meq/g.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

It is understood that the test methods that are disclosed in the Test Methods Section of the present application must be used to determine the respective values of the parameters of the compositions and methods described and claimed herein.

Liquid Detergent Composition

The present disclosure relates to detergent compositions. The detergent compositions may be fabric care compositions. The compositions may be used as a pre-laundering treatment or during the wash cycle. The liquid detergent composition may be a heavy duty laundry detergent. TIDE, GAIN, and ARIEL are brand-name examples of commercially available heavy duty laundry detergents, available from The Procter & Gamble Company (Cincinnati, Ohio, USA).

The detergent composition may be a liquid. The liquid detergent may have a viscosity from about 1 to about 2000 centipoise (1-2000 mPa·s), or from about 200 to about 800 centipoise (200-800 mPa·s). The viscosity is determined using a Brookfield viscometer, No. 2 spindle, at 60 RPM/s, measured at 25° C.

The detergent composition may be in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the detergent composition is contained in at least one of the compartments. The compartments may be arranged in superposed orientation, i.e., one positioned on top of the other, where they may share a common wall. At least one compartment may be superposed on another compartment. Alternatively, the compartments may be positioned in a side-by-side orientation, i.e., one orientated next to the other. The compartments may even be orientated in a "tire and rim" arrangement, i.e., a first compartment is positioned next to a second compartment, but the first compartment at least partially surrounds the second compartment, but does not completely enclose the second compartment. Alternatively, one compartment may be completely enclosed within another compartment.

The unit dose form may comprise water-soluble film that forms the compartment and encapsulates the detergent composition. Preferred film materials are polymeric materials; for example, the water-soluble film may comprise polyvinyl alcohol. The film material can, for example, be obtained by casting, blow-molding, extrusion, or blown extrusion of the polymeric material, as known in the art. Suitable films include those supplied by Monosol (Merrillville, Ind., USA)

under the trade references M8630, M8900, M8779, M8310, and M9467. The films and/or the compositions contained therein may include an aversive agent, such as denatonium benzoate, to deter ingestion.

The detergent composition may comprise water. The composition may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

Surfactant System

The detergent compositions of the present disclosure comprise a surfactant system. Surfactant systems are known to provide cleaning benefits. However, it has been found that careful selection of particular surfactant systems can also provide deposition benefits when used in combination with certain encapsulates.

The detergent compositions of the present disclosure may include a surfactant system in an amount sufficient to provide desired cleaning properties. The detergent composition may comprise, from about 8%, or from about 10%, or from about 15%, or from about 20%, to about 50%, or to about 30%, or to about 25%, or to about 20%, by weight of the composition, of a surfactant system.

The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material. As used herein, fatty acids and their salts are understood to be part of the surfactant system, and more specifically, part of the anionic surfactant.

Anionic Surfactant/Nonionic Surfactant Combinations

The surfactant system may comprise anionic surfactant and nonionic surfactant in a weight ratio. The careful selection of the weight ratio of anionic surfactant to nonionic surfactant may help to provide the desired levels of cleaning and encapsulate-deposition benefits.

The surfactant system may comprise anionic surfactant and nonionic surfactant present in a weight ratio of from about 1:1 to about 4.5:1. The weight ratio of anionic surfactant to nonionic surfactant may be from about 1:1, or from about 2:1, to about 4.5, or to about 3.8:1, or to about 3.6:1, or to about 3:1, or to about 2.9:1, or to about 2.7:1, or to about 2:1. Suitable anionic surfactants and nonionic surfactants are described in more detail below.

Anionic Surfactant

The surfactant systems of the present disclosure may comprise anionic surfactant. The surfactant system of the cleaning composition may comprise from about 1% to about 80%, by weight of the surfactant system, of anionic surfactants. The surfactant system may comprise up to about 80%, or up to about 75%, or up to about 67%, or up to about 60%, or up to about 55%, or up to about 50%, by weight of the surfactant system, of anionic surfactant.

The anionic surfactant may include conventional anionic surfactants useful for treating surfaces such as fabrics. The anionic surfactant present in the surfactant system may comprise an anionic sulphate surfactant and an anionic sulphonate surfactant in a weight ratio. Without wishing to be bound by theory, it is believed that when the amount of sulphate surfactant is equal to or greater than the amount of sulphonate surfactant present in the surfactant system, encapsulate deposition efficiency may improve. The anionic surfactants may be neutralized with alkali metal salts or with amines, such as alkanolamines like monoethanolamine or triethanolamine.

The weight ratio of the anionic sulphate surfactant and an anionic sulphonate surfactant may be from about 1:1 to about 20:1. The anionic sulphate surfactant and the anionic sulphonate surfactant may be present in a weight ratio of from about 1:1, or from about 1.5:1, or from about 2:1, to about 20:1, or to about 15:1, or to about 10:1, or to about 5:1, or to about 2.5:1, or to about 2:1; the weight ratio may be from about 2:1 to about 3:1. The anionic sulphate surfactant may comprise alkoxylated alkyl sulphate surfactant, or even ethoxylated alkyl sulphate surfactant ("AES"), in any of the above-mentioned ratios. The anionic sulphonate surfactant may comprise alkyl benezene sulphonate surfactant, or even linear alkyl benzene sulphonate surfactant ("LAS"), in any of the above-mentioned ratios. The sulphate and sulphonate surfactants are discussed in more detail below.

The anionic sulphate surfactant may include alkoxylated alkyl sulphate surfactant. The alkoxylated alkyl sulphate surfactant may be present as a major portion of the surfactant system. The alkoxylated alkyl sulphate surfactant may comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups.)

The alkyl group may have from about 8 to about 20 carbon atoms, or from about 10, or from about 12, to about 18, or to about 16, or to about 14, carbon atoms. The anionic alkoxylated alkyl sulphate surfactant may include an alkoxylated C10-C16, preferably C12-C16, more preferably C12-C14, sulphate surfactant.

The alkoxylated alkyl sulfate surfactant may be a mixture of alkoxylated alkyl sulfates, where the mixture has an average (arithmetic mean) carbon chain length within the range of about 8 to about 30 carbon atoms, or of about 8 to about 20, or of about 10 to about 16, or of about 12 to about 16, or of about 12 to about 14, carbon atoms.

The alkoxylated alkyl sulfate surfactant may have an average (arithmetic mean) degree of alkoxylation of from about 1 mol to about 5 mols of alkoxy groups. The ethoxylated alkyl sulfate surfactant may have an average (arithmetic mean) degree of ethoxylation of from about 1 mol to about 5 mols, or of about 1 to about 4, or of about 1 to about 3, or of from about 1.5 to about 3, of ethoxy groups. In other words, the sulphate surfactant may have an average degree of ethoxylation of from about 1 to about 5, or from about 1 to about 4, or from about 1 to about 3, or from about 1.5 to about 3. The average degree of ethoxylation may be about 1.8, or it may be about 3.

The anionic alkoxylated alkyl sulphate surfactant may be a C12-C15, or even a C12-C14, sulphate surfactant having a degree of ethoxylation of about 1.5 to about 3.

The anionic sulphate surfactant may include non-alkoxylated alkyl sulphate surfactants, such as those produced by the sulfation of higher $C_8$-$C_{20}$ fatty alcohols. Primary alkyl sulfate surfactants may have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium. The detergent compositions described herein may include no more than 5%, by weight of the surfactant system, if any, of a non-alkoxylated alkyl sulphate surfactant.

The anionic sulphonate surfactant may include alkyl benzene sulphonate surfactant. The alkyl benzene sulphonate surfactant may include alkali metal salts and/or (alkylol)amine salts of alkyl benzene sulfonates, in which the alkyl group contains from about 9 to about 15 carbon atoms, in straight chain (linear) or branched chain configuration. The alkyl group may be linear. Such linear alkylbenzene sulfonates are known as "LAS." The linear alkylbenzene sulfonate may have an average number of carbon atoms in the alkyl group of from about 11 to 14. The linear straight chain alkyl benzene sulfonates may have an average number of carbon atoms in the alkyl group of about 11.8 carbon atoms, which may be abbreviated as C11.8 LAS. The detergent compositions described herein may include no more than 5%, by weight of the surfactant system, if any, of an alkyl sulphonate surfactant, such as alkyl benzene sulphonate surfactant, e.g., linear alkyl benzene sulphonate surfactant.

The detergent compositions of the present disclosure may comprise a fatty acid and/or its salt. Without wishing to be bound by theory, it is believed that in the present compositions, fatty acids and/or their salts may interact with the cationic deposition aid polymer and contribute to deposition. However, fatty acid may not required in the present compositions, and there may be processing, cost, and stability advantages to minimizing fatty acid levels, or even eliminating fatty acids completely.

The composition may comprise from about 0.1%, or from about 0.5%, or from about 1%, to about 20%, or to about 10%, or to about 8%, or to about 5%, or to about 4%, or to about 3%, or to about 2%, by weight of the composition, of fatty acid and/or its salt. The composition may comprise from about 0.1% to about 4%, by weight of the composition, of fatty acid and/or its salt. The detergent composition may be substantially free (or even contain 0%) of fatty acids and their salts.

Suitable fatty acids and salts include those having the formula R1COOM, where R1 is a primary or secondary alkyl group of 4 to 30 carbon atoms, and where M is a hydrogen cation or another solubilizing cation. In the acid form, M is a hydrogen cation; in the salt form, M is a solubilizing cation that is not hydrogen. The fatty acid or salt may be selected such that the pKa of the fatty acid or salt is less than the pH of the non-aqueous liquid composition. The composition may have a pH of from 6 to 10.5, or from 6.5 to 9, or from 7 to 8.

The alkyl group represented by R1 may represent a mixture of chain lengths and may be saturated or unsaturated, although it is preferred that at least two thirds of the R1 groups have a chain length of between 8 and 18 carbon atoms. Non-limiting examples of suitable alkyl group sources include the fatty acids derived from coconut oil, tallow, tall oil, rapeseed-derived, oleic, fatty alkylsuccinic, palm kernel oil, and mixtures thereof For the purposes of minimizing odor, however, it is often desirable to use primarily saturated carboxylic acids.

The solubilizing cation, M (when M is not a hydrogen cation), may be any cation that confers water solubility to the product, although monovalent moieties are generally preferred. Examples of suitable solubilizing cations for use with this disclosure include alkali metals such as sodium and potassium, and amines such as monoethanolamine, triethanolammonium, ammonium, and morpholinium. Although, when used, the majority of the fatty acid should be incorporated into the composition in neutralized salt form, it is often preferable to leave an amount of free fatty acid in the composition, as this can aid in the maintenance of the viscosity of the composition, particularly when the composition has low water content, for example less than 20%.

Nonionic Surfactant

The surfactant systems of the present disclosure may also include nonionic surfactant. Nonionic surfactant may be present in the surfactant system at levels of from about 1% to about 50%, or to about 40%, or to about 33%, or to about 25%, or to about 20%, or to about 10%, by weight of the surfactant system.

Suitable nonionic surfactants useful herein can include any conventional nonionic surfactant. These may include alkoxylated nonionic surfactants and amine oxide surfactants.

Alkoxylated nonionic surfactants may include the ethoxylated alcohols and ethoxylated alkyl phenols. The nonionic surfactants may be of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfacatant may be a nonionic alkoxylated fatty alcohol surfactant, preferably a nonionic ethoxylated fatty alcohol surfactant. The nonionic surfactant may have an average of from about 12 to about 14 carbon atoms, and an average degree of ethoxylation of about 7 to about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, $BAE_x$, wherein x is from 1 to 30; alkylpolysaccharides; alkylpolyglycosides; polyhydroxy fatty acid amides; and ether capped poly(oxyalkylated) alcohol surfactants; and mixtures thereof.

Encapsulates

Figure 2:
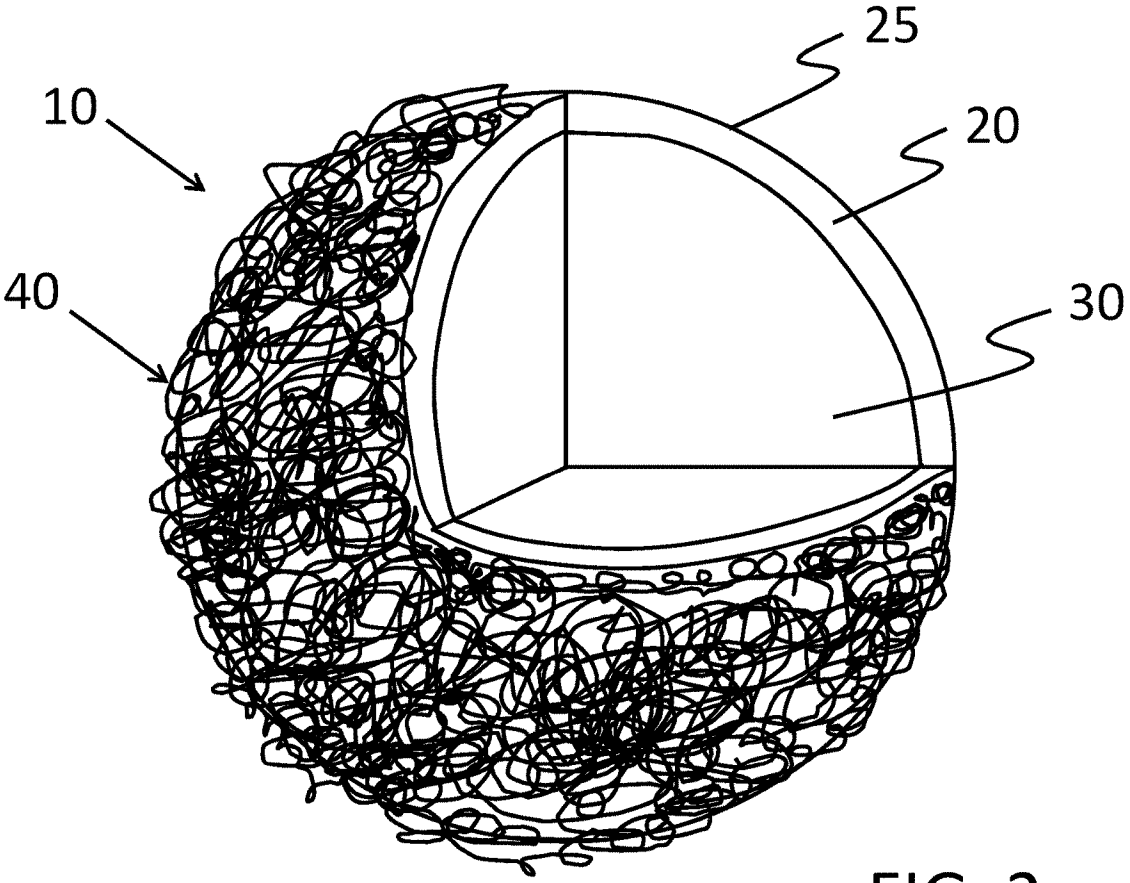
FIG. 2 shows a schematic of an encapsulate 10 according to the present disclosure, where the encapsulate 10 includes a coating 40.

The detergent compositions of the present disclosure may comprise encapsulates. As shown in FIG. 1, an encapsulate 10 may include a core 30 and a wall 20 at least partially surrounding the core 30. The core 30 may include a benefit agent, such as perfume. The wall 20 may include an outer surface 25. As shown in FIG. 2, the outer surface 25 may include a coating 40. The coating 40 may include an efficiency polymer. These elements are discussed in more detail below.

The composition may comprise from about 0.1%, or from about 0.2%, or from about 0.3%, or from about 0.4%, or from about 0.5%, to about 5%, or to about 2.5%, or to about 2%, or to about 1%, by weight of the composition, of encapsulates. The composition may include from about 0.1% to about 1%, by weight of the composition, of encapsulates.

The encapsulates may be friable. The encapsulates' particle size can be measured by typical methods known in the art such as with a Malvern particle sizer. The encapsulates may have a mean particle size of from about 10 microns to about 500 microns, or to about 200 microns, or to about 100 microns, or to about 50 microns, or to about 30 microns. A plurality of encapsulates may form aggregates.

The encapsulates may have a cationic charge at a pH range from about 2 to about 10, from about 3 to about 9, or from about 4 to about 8.

The encapsulate may have a wall, which may at least partially surround the core. The wall may include a wall material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof. The wall material may be selected from the group consisting of an aminoplast, an acrylic, an acrylate, and mixtures thereof.

The wall material may include an aminoplast. The aminoplast may include a polyurea, polyurethane, and/or polyureaurethane. The aminoplast may include an aminoplast copolymer, such as melamine-formaldehyde, urea-formaldehyde, cross-linked melamine formaldehyde, or mixtures thereof. The wall material may include melamine formaldehyde, and the wall may further include a coating as described below. The encapsulate may include a core that comprises perfume, and a wall that includes melamine formaldehyde and/or cross linked melamine formaldehyde. The encapsulate may include a core that comprises perfume, and a wall that comprises melamine formaldehyde and/or cross linked melamine formaldehyde, poly(acrylic acid) and poly(acrylic acid-co-butyl acrylate).

The outer wall of the encapsulate may include a coating. Certain coatings may improve deposition of the encapsulate onto a target surface, such as a fabric. The encapsulate may have a coating-to-wall weight ratio of from about 1:200 to about 1:2, or from about 1:100 to about 1:4, or even from about 1:80 to about 1:10.

The coating may comprise an efficiency polymer. The coating may comprise a cationic efficiency polymer. The cationic polymer may be selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof. The coating may comprise a polymer selected from the group consisting of polyvinyl amines, polyvinyl formamides, polyallyl amines, copolymers thereof, and mixtures thereof.

The coating may comprise polyvinyl formamide. The polyvinyl formamide may have a hydrolysis degree of from about 5% to about 95%, from about 7% to about 60%, or even from about 10% to about 40%.

One or more of the efficiency polymers may have an average molecular mass from about 1,000 Da to about 50,000,000 Da, from about 5,000 Da, to about 25,000,000 Da, from about 10,000 Da to about 10,000,000 Da, or even from about 340,000 Da to about 1,500,000 Da. One or more of the efficiency polymers may have a charge density from about 1 meq/g efficiency polymer to about 23 meq/g efficiency polymer, from about 1.2 meq/g efficiency polymer and 16 meq/g efficiency polymer, from about 2 meq/g efficiency polymer to about 10 meq/g efficiency polymer, or even from about 1 meq/g efficiency polymer to about 4 meq/g efficiency polymer.

The core of the encapsulate may include a benefit agent. Suitable benefit agents may include perfume raw materials, silicone oils, waxes, hydrocarbons, higher fatty acids, essential oils, lipids, skin coolants, vitamins, sunscreens, antioxidants, glycerine, catalysts, bleach particles, silicon dioxide particles, malodor reducing agents, odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. The benefit agent may include perfume raw materials.

The encapsulates may include a core that comprises perfume raw materials, and a wall that includes melamine formaldehyde and/or cross linked melamine formaldehyde, where the wall further comprises a coating on an outer surface of the wall, where the coating includes an efficiency polymer such as polyvinyl formamide.

Suitable encapsulates may be obtained from Encapsys (Appleton, Wis., USA). The detergent compositions may include mixtures of different encapsulates, for example encapsulates having different wall materials and/or benefit agents.

The present detergent compositions may further include formaldehyde scavengers. Such scavengers may be useful in or with certain encapsulates, particularly encapsulates that include and/or release formaldehyde. Suitable formaldehyde scavengers may include: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or mixtures thereof.

Cationic Deposition Aid Polymer

The liquid detergent compositions of the present disclosure may include a deposition aid polymer. The deposition aid polymer may be a non-polysaccharide deposition aid polymer. The deposition aid polymer may be a cationic deposition aid polymer. Without wishing to be bound by theory, it is believed that the deposition aid polymer facilitates the deposition of encapsulates onto a target surface, such as a fabric, by forming a separated phase with anionic surfactant and/or fatty acid that helps to deposit and retain encapsulates on fabric. For clarity, as used herein, the cationic deposition aid polymers are understood to be different polymers than the efficiency polymers that may be present as a coating on the encapsulates prior to addition of the encapsulates to a base detergent mixture (e.g., a coating present in an encapsulate premix).

Cationic polymers are known to contribute to fabric whiteness and/or cleaning losses, which is a factor that limits wider usage of such polymers. However, the applicants have discovered that by controlling the presently described polymer's cationic charge and molecular weight within particular ranges, whiteness/cleaning losses on fabric can be minimized, and encapsulate deposition benefits can be maintained or improved, in comparison with conventional cationic polymers, particular in the presence of the surfactant systems disclosed herein.

Further, product viscosity can be impacted by molecular weight and cationic content of the cationic polymer. Molecular weights of polymers of the present disclosure are also selected to minimize impact on product viscosity to avoid product instability and stringiness associated with high molecular weight and/or broad molecular weight distribution. Thus, the cationic polymers of the present disclosure are typically characterized by a relatively high charge density and a relatively low molecular weight.

Many cationic polymers common for usage in fabric care have high molecular weights, for example as a high as 1000 kDaltons or more. In contrast, the cationic polymers described herein have relatively low weight average molecular weights. The cationic polymer may have a weight average molecular weight of from about 5 kDaltons to about 200 kDaltons. The cationic polymer may have a weight average molecular weight of from about 10 kDaltons, or from about 15 kDaltons, or from about 18 kDaltons, or from about 20 kDaltons, to about 200 kDaltons, or to about 100 kDaltons, or o about 50 kDaltons, or to about 30 kDaltons. The method for determining weight average molecular weight is provided below in the Test Methods section.

In order to maintain cleaning and/or whiteness benefits in detergent compositions, it is known in the art to employ cationic polymers that have a relatively low cationic charge density, for example, less than 4 meq/g. However, it has been surprisingly found that in the present compositions, a cationic polymer with a relatively high charge density, e.g., greater than 4 meq/g may be used while maintaining good cleaning and/or whiteness benefits. Therefore, the cationic polymers described herein may be characterized by a cationic charge density of from about about 4 meq/g, or from about 5 meq/g, or from about 5.2 meq/g to about 12 meq/g, or to about 10 meq/g, or to about 8 meq/g or to about 7 meq/g, or to about 6.5 meq/g. The cationic polymers described herein may be characterized by a cationic charge density of from about 4 meq/g to about 12 meq/g, or from about 4.5 meq/g to about 7 meq/g. An upper limit on the cationic charge density may be desired, as the viscosity of cationic polymers with cationic charge densities that are too high may lead to formulation challenges.

The detergent compositions may comprise from about 0.01% to about 2%, or to about 1.5%, or to about 1%, or to about 0.75%, or to about 0.5%, or to about 0.3%, or from about 0.05% to about 0.25%, by weight of the detergent composition, of cationic polymer.

The cationic polymers described herein may be substantially free of, or free of, any silicone-derived structural unit. It is understood that such a limitation does not preclude the detergent composition itself from containing silicone, nor does it preclude the cationic polymers described herein from complexing with silicone comprised in such detergent compositions or in a wash liquor.

The compositions of the present disclosure may be substantially free of polysaccharide-based cationic polymers, such as cationic hydroxyethylene cellulose, particularly when the compositions comprise enzymes such as cellulase, amylase, lipase, and/or protease. Such polysaccharide-based polymers are typically susceptible to degradation by cellulase enzymes, which are often present at trace levels in commercially-supplied enzymes. Thus, compositions comprising polysaccharide-based cationic polymers are typically incompatible with enzymes in general, even when cellulase is not intentionally added. Thus, in some aspects, the compositions of the present case are non-polysaccharide based cationic polymers.

The cationic polymer may comprise structural units. The structural units may be nonionic, cationic, anionic, or mixtures thereof. The polymers described herein may comprise non-cationic structural units, but the polymers are still characterized by having a net cationic charge.

The cationic polymer may consist of only one type of structural unit, i.e., the polymer is a homopolymer. The cationic polymer may consist of two types of structural units, i.e., the polymer is a copolymer. The cationic polymer may consist of three types of structural units, i.e., the polymer is a terpolymer. The cationic polymer may comprise two or more types of structural units. The structural units may be described as first structural units, second structural units, third structural units, etc. The structural units, or monomers, can be incorporated in the cationic polymer in a random format or in a blocky format.

The cationic polymer may comprise a nonionic structural unit. The cationic polymer may comprise from about 5 mol % to about 60 mol %, or from about 15 mol % to about 40 mol %, or from about 15 mol % to about 30 mol %, of a nonionic structural unit. In some aspects, the cationic polymer comprises a nonionic structural unit derived from a monomer selected from the group consisting of (meth) acrylamide, vinyl formamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

The cationic polymer may comprise a cationic structural unit. The cationic polymer may comprise from about 20 mol % to about 100 mol %, or from about 30 mol % to about 100 mol %, or from about 50 mol % to about 100 mol %, or from about 55 mol % to about 95 mol %, or from about 60 mol % to about 85 mol %, or from about 70 mol % to about 85 mol %, of a cationic structural unit.

The cationic polymer may comprise a cationic structural unit derived from a cationic monomer. The cationic monomer may be selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof. The cationic monomer may be selected from the group consisting of diallyl dimethyl ammonium salts (DADMAS), N,N-dimethyl aminoethyl acrylate, N,N-dimethyl aminoethyl methacrylate (DMAM), [2-(methacryloylamino)ethyl]tri-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

The cationic polymer may comprise a cationic monomer derived from from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof. Typically, DADMAS, APTAS, and MAPTAS are salts comprising chloride (i.e. DADMAC, APTAC, and/or MAPTAC).

The cationic polymer may comprise an anionic structural unit. The cationic polymer may comprise from about 0.01 mol % to about 15 mol %, or from about 0.05 mol % to about 10 mol %, or from about 0.1 mol % to about 5 mol %, or from about 1% to about 4% of an anionic structural unit. The polymer may comprise 0% of an anionic structural unit, i.e., is substantially free of an anionic structural unit. The anionic structural unit may be derived from an anionic monomer selected from the group consisting of acrylic acid (AA), methacrylic acid, maleic acid, vinyl sulfonic acid, styrene sulfonic acid, acrylamidopropylmethane sulfonic acid (AMPS) and their salts, and mixtures thereof.

The cationic polymer is selected from acrylamide/DADMAS, acrylamide/DADMAS/acrylic acid, acrylamide/APTAS, acrylamide/MAPTAS, acrylamide/QVi, polyvinyl formamide/DADMAS, poly(DADMAS), acrylamide/MAPTAS/acrylic acid, acrylamide/APTAS/acrylic acid, and mixtures thereof.

The composition may comprise a cationic polymer, where the cationic polymer comprises (i) from about 5 mol % to about 50 mol %, or from about 15 mol % to about 30 mol %, of a first structural unit derived from (meth)acrylamide; and (ii) from about 50 mol % to about 95 mol %, or from about 70 mol % to about 85 mol %, of a second structural unit derived from a cationic monomer, where the cationic monomer may be derived from DADMAC, where the cationic polymer is characterized by a weight average molecular weight of from about 15 kDaltons to about 50 kDaltons.

External Structuring System

The liquid detergent compositions of the present disclosure may include an external structuring system. The structuring system may be used to provide sufficient viscosity to the composition in order to provide, for example, suitable pour viscosity, phase stability, and/or suspension capabilities. The external structuring system may be particularly useful for suspending the encapsulates.

The composition of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

The compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the final unit dose laundry detergent composition. Suitable crystallizable glycerides include hydrogenated castor oil or "HCO" or derivatives thereof, provided that it is capable of crystallizing in the liquid detergent composition.

The detergent composition may comprise from about 0.01% to 5% by weight of a naturally derived and/or synthetic polymeric structurant. Suitable naturally derived polymeric structurants include: cellulose fibers, hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable cellulose fibers may comprise fibers having an aspect ratio (length to width ratio) from about 50 to about 100,000, preferably from about 300 to about 10,000 and include mineral fibers, fermentation derived cellulose fibers, fibers derived from mono- or di-cotyledons such as vegetables, fruits, seeds, stem, leaf and/or wood derived cellulose fibers and mixtures thereof. Commercially available examples are Avicel® from FMC, Citri-Fi from Fiberstar, Herbacel from Herbafood and Cellulon PX from CP Kelco. Suitable synthetic polymeric structurants include: polycarboxylates, polyacrylates and hydrophobically modified polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

Adjuncts

The detergent compositions of the present disclosure may include other suitable adjuncts, such as adjuncts that provide fabric care benefits. As the presently disclosed compositions may have surfactant systems that are rich in one particular surfactant, such adjuncts may be particularly desirable to provide a broader cleaning profile or other consumer-relevant benefits, such as softness benefits. Suitable adjuncts include enzymes, brighteners, cleaning polymers such as alkoxylated polyalkyleneimines, soil release polymers, polyetheramines, hueing dyes, and combinations thereof. Typical usage levels range from as low as 0.001% by weight of composition for adjuncts such as optical brighteners or hueing dyes up to 50% by weight of composition for builders or solvents. Several suitable adjuncts are discussed in more details below.

Enzymes

The cleaning compositions of the present disclosure may comprise enzymes. Enzymes may be included in the cleaning compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the cleaning compositions described herein include hemicellulases, gluco-amylases, xylanases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

The composition may comprise at least two, or at least three, or at least four enzymes. The composition may comprise at least an amylase and a protease.

Mannanase, protease, and cellulase may be purchased under the trade names, respectively, Mannaway, Savinase, and Celluclean, from Novozymes (Denmark), and may provide, respectively, 4 mg, 15.8 mg, and 15.6 mg active enzyme per gram.

Commercially available enzymes may contain trace amounts of cellulase, up to 1% of the enzyme mixture, even though cellulase is not the predominant or target enzyme in the enzyme mixture. Therefore, the detergent compositions of the present disclosure may comprise cellulase, for example at trace levels, such as present at levels of up to 0.005 wt %, by weight of the composition. Typically, cellulase is not compatible with cellulosic-/polysaccharide-based molecules, such as certain cationic polysaccharide polymers, such as cationic hydroxyethyl cellulose. If cellulase impurities are present, the cationic hydroxyethyl cellulose polymers are acted upon by the enzyme rendering them ineffective as deposition aids. Removing trace amounts of cellulase from protease mixtures to be compatible with cationic hydroxyethyl cellulose results in higher enzyme costs, and makes it difficult during processing to re-blend detergent compositions containing cellulase impurities with detergent compositions containing cationic hydroxyethyl cellulose to avoid waste. Therefore, it is useful to provide detergent compositions containing cationic deposition aids that are compatible with enzyme mixtures containing trace amounts of cellulase.

Enzymes are normally incorporated into cleaning compositions at levels sufficient to provide a "cleaning-effective amount." The phrase "cleaning effective amount" refers to any amount capable of producing a cleaning, stain removal, soil removal, whitening, deodorizing, or freshness improving effect on soiled material such as fabrics, hard surfaces, and the like. In some aspects, the detergent compositions may comprise from about 0.0001% to about 5%, or from about 0005% to about 3%, or from about 0.001% to about 2%, of active enzyme by weight of the cleaning composition. The enzymes can be added as a separate single ingredient or as mixtures of two or more enzymes.

Brighteners

The detergent compositions described herein may include an optical brightener. Optical brighteners, also known as fluorescent whitening agents, are well-known in the art. The detergent compositions of the present invention may comprise from about 0.005%, or from about 0.01%, to about 5%, or to about 1%, or to about 0.5%, by weight of the composition, of a brightener.

The optical brightener may be a substantially insoluble compound selected from compounds comprising stilbene, pyrazoline, coumarin, carboxylic acids, methinecyanines, dibenzothiophene-5,5-dioxide, azoles, 5- and 6-membered-ring heterocyclic, benzene or derivatives thereof and mixtures thereof. The brightener comprises a benzoxozol, pyrazole, triazole, triazine, imidazole, furan group or mixtures thereof.

Suitable brighteners include disodium 4,4'-bis {[4-anilino-6morpholino-s-triazin-2-yl]amino}-2,2'-stilbenedisulfonatedisodium 4,4'-bis-(2-sulfostryl)biphenyl; and disodium 4,4'-bis[{4,6-di-anilino-s-triazin-2-yl]-amino}-2,2' stilbene disulfonate. Commercially available brighteners include Brightener 15, Brightener 36, and Brightener 49, available from Ciba Geigy.

Cleaning Polymers

The composition may include cleaning polymers. For example, the detergent composition may comprise amphiphilic alkoxylated grease cleaning polymers, which may have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkyleneimines, for example. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The alkoxylated polyalkyleneimines may have an inner polyethylene oxide block and an outer polypropylene oxide block. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Soil Release Polymers (SRPs)

The detergent compositions of the present disclosure may comprise a soil release polymer. In some aspects, the detergent compositions may comprise one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Amines

The cleaning compositions described herein may contain an amine. Non-limiting examples of amines include, but are not limited to, etheramines, cyclic amines, polyamines, oligoamines (e.g., triamines, diamines, pentamines, tetraamines), or combinations thereof. The compositions described herein may comprise an amine selected from the group consisting of oligoamines, etheramines, cyclic amines, and combinations thereof.

The cleaning compositions may include from about 0.1% to about 10%, or from about 0.2% to about 5%, or from about 0.5% to about 4%, or from about 0.1% to about 4%, or from about 0.1% to about 2%, by weight of the composition, of an amine. The amine can be subjected to protonation depending on the pH of the cleaning medium in which it is used.

Examples of suitable oligoamines include tetraethylenepentamine, triethylenetetraamine, diethylenetriamine, and mixtures thereof. Etheramines and cyclic amines are described in more detail below.

Suitable etheramines may be represented by Formula (A):

Formula (A)

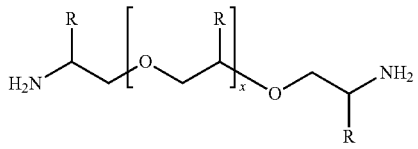

where each R group is independently selected from the group consisting of H, a methyl group, and an ethyl group, where at least one R group is a methyl group, x is in the range of about 2 to about 300. x indicates the average number of repeated units or basic building blocks that constitute the polymer. x may be a whole number or a fraction. x may be in the range of about 2 and about 20, or about 2 to about 10.

Suitable etheramines may be represented by Formula (I):

Formula (I)

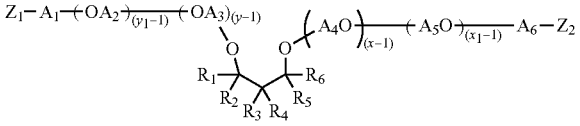

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, or about 2 to about 20, or about 2 to about 10, or about 2 to about 8, or about 3 to about 8, or about 4 to about 6, where $x \geq 1$ and $y \geq 1$ and the sum of $x_1+y_1$ is in the range of about 2 to about 200, or about 2 to about 20, or about 2 to about 10, or about 2 to about 8, or about 3 to about 8, or about 2 to about 4, where $x_1 \geq 1$ and $y_1 \geq 1$.

In the etheramine of Formula (I), each of $A_1$-$A_6$ may be independently selected from ethylene, propylene, or butylene; typically, each of $A_1$-$A_6$ is propylene. Each of $A_1$ and $A_6$ may be independently selected from linear alkanediyl groups having 2 to 18 carbon atoms, or 2-10 carbon atoms, or 2-5 carbon atoms; each of $A_2$, $A_3$, $A_4$, and $A_5$ may be independently selected from linear or branched alkanediyl groups having 2 to 18 carbon atoms, or 2-10 carbon atoms, or 2-5 carbon atoms. In the etheramine of Formula (I), each of $R_1$, $R_2$, $R_5$, and $R_6$ may be H and each of $R_3$ and $R_4$ may be independently selected from C1-C16 alkyl or aryl; typically each of $R_1$, $R_2$, $R_5$, and $R_6$ may be H and each of $R_3$ and $R_4$ may be independently selected from a butyl group, an ethyl group, a methyl group, a propyl group, or a phenyl group. In the etheramine of Formula (I), $R_3$ may be an ethyl group, each of $R_1$, $R_2$, $R_5$, and $R_6$ may be H, and $R_4$ may be a butyl group. In the etheramine of Formula (I), each of $R_1$ and $R_2$ may be H and each of $R_3$, $R_4$, $R_5$, and $R_6$ may be independently selected from an ethyl group, a methyl group, a propyl group, a butyl group, a phenyl group, or H.

Suitable etheramines may be represented by Formula (II):

Formula (II)

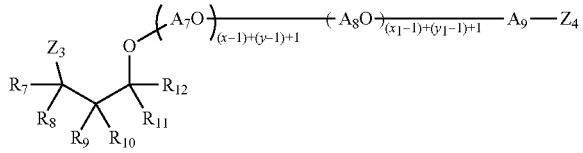

each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, or about 2 to about 20, or about 2 to about 10, or about 2 to about 8, or about 3 to about 8, or about 2 to about 4, where $x \geq 1$ and $y \geq 1$ and the sum of $x_1+y_1$ is in the range of about 2 to about 200, or about 2 to about 20, or about 2 to about 10, or about 2 to about 8, or about 3 to about 8, or about 2 to about 4, where $x_1 \geq 1$ and $y_1 \geq 1$.

In the etheramine of Formula (II), each of $A_7$-$A_9$ may be independently selected from ethylene, propylene, or butylene; typically each of $A_7$-$A_9$ may be propylene. $A_9$ may be selected from linear alkanediyl groups having 2 to 18 carbon atoms, or 2-10 carbon atoms, or 2-5 carbon atoms; each of $A_7$ and $A_8$ may be independently selected from linear or branched alkanediyl groups having 2 to 18 carbon atoms, or 2-10 carbon atoms, or 2-5 carbon atoms. In the etheramine of Formula (II), each of $R_7$, $R_8$, $R_{11}$, and $R_{12}$ may be H and each of $R_9$ and $R_{10}$ may be independently selected from C1-C16 alkyl or aryl; typically each of $R_7$, $R_8$, $R_{11}$, and $R_{12}$ may be H and each of $R_9$ and $R_{10}$ may be independently selected from a butyl group, an ethyl group, a methyl group, a propyl group, or a phenyl group. In the etheramine of Formula (II), $R_9$ is an ethyl group, each of $R_7$, $R_8$, $R_{11}$, and $R_{12}$ may be H, and $R_{10}$ may be a butyl group. In the etheramine of Formula (II), each of $R_7$ and $R_8$ may be H and each of $R_9$, $R_{10}$, $R_{11}$, and $R_{12}$ may be independently selected from an ethyl group, a methyl group, a propyl group, a butyl group, a phenyl group, or H.

Suitable etheramines are further described in US2014/0296127A1 and US2015/0057212A1.

Suitable cyclic amines may be represented by Formula (B):

Formula (B)

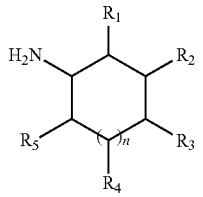

The substituents "Rs" can be independently selected from $NH_2$, H and linear, branched alkyl or alkenyl from 1 to 10 carbon atoms. For the purpose of this invention "Rs" includes R1-R5. At least one of the "Rs" needs to be $NH_2$. The remaining "Rs" can be independently selected from $NH_2$, H and linear, branched alkyl or alkenyl having from 1 to 10 carbon atoms. n is from 0 to 3, or n is 1.

Hueing Agents

The composition may comprise a fabric hueing agent (sometimes referred to as shading, bluing, or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Other Adjuncts

The compositions described herein may include other adjunct materials, which may be suitable for laundry processes. Suitable adjuncts include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, organic solvents, anti-microbial agents and/or preservatives, neutralizers and/or pH adjusting agents, processing aids, opacifiers, pearlescent agents, pigments, or mixtures thereof.

Silicones may contribute to cleaning and/or whiteness losses on fabrics. Therefore, the detergent compositions may contain less than 0.3% of silicone. The detergent compositions may be substantially free (e.g., less than 0.1%, less than 0.01%, or even 0%) of silicones such as aminosilicone. It is recognized that silicones may be present in a detergent as a suds suppressor; therefore, the detergent may include low levels of silicones, for example where the level is sufficient to provide at least some anti-foam benefits, but not sufficient to provide a consumer-noticeable softness benefit.

Methods of Making the Detergent Composition

The detergent compositions of the present disclosure may be made by conventional methods, including batch or continuous loop processes. When an external structuring system is used, the external structuring system may be added to a base detergent after the encapsulates are added, and then mixed.

Methods of Using the Detergent Composition

The present disclosure relates to a method of pretreating or treating a surface, such as a fabric, where the method includes the step of contacting the surface (e.g., fabric) with the detergent composition described herein. The contacting step may occur in the presence of water, where the water and the detergent composition form a wash liquor. The contacting may occur during a washing step, and water may be added before, during, or after the contacting step to form the wash liquor.

The washing step may be followed by a rinsing step. During the rinsing step, the fabric may be contacted with a fabric softener composition, wherein said fabric softener composition comprises a fabric softening active. The step of contacting the fabric with a fabric softening composition may occur in the presence of water, for example during a rinse cycle of an automatic washing machine.

Any suitable washing machine may be used, for example, a top-loading or front-loading automatic washing machine. Those skilled in the art will recognize suitable machines for the relevant wash operation. The compositions of the present disclosure may be used in combination with other compositions, such as fabric additives, rinse aids, and the like.

The softener compositions of the present disclosure may take any suitable form, such as liquid, gel, foam, or solid (such as beads, for example those described in U.S. Pat. No. 7,867,968, or a dryer machine bar), or the composition may be used in combination with a flexible substrate, e.g., a dryer sheet, such as those described in U.S. Pat. Nos. 5,102,564, 5,578,234, 5,470,492, WO1999/015611, USPA 2007/0270327A1, each of which is incorporated herein by reference.

Typically, the softener composition is a liquid. In some aspects, the softener compositions comprise from about 60% to about 95%, preferably from about 65% to about 90%, by weight of the softener composition, of an aqueous liquid carrier. The preferred aqueous carrier is water, which can contain minor ingredients.

Suitable commercially available fabric softeners may also be used, such DOWNY® and LENOR® (both available from The Procter & Gamble Company), as well as SNUGGLE® (available from The Sun Products Corporation).

The softener compositions described herein comprise a fabric softening active ("FSA"). The term "fabric softening active" or "FSA" is used herein in the broadest sense to include any active that is suitable for softening a fabric. In some aspects, the softener compositions comprise, based on total softener composition weight, from about 2% to about 25%, or from about 3% to about 15%, or even from about 3% to about 7% of one or more fabric softening actives. In some aspects, the fabric softening active is a cationic fabric softening active. Typical fabric softening actives are described below.

In some aspects, the FSA of the methods described herein comprises a quaternary ammonium compound, silicone, fatty acids or esters, sugars, fatty alcohols, alkoxylated fatty alcohols, polyglycerol esters, oily sugar derivatives, wax emulsions, fatty acid glycerides, or mixtures thereof.

In some aspects, the FSA is a quaternary ammonium compound suitable for softening fabric in a rinse step. In one embodiment, the FSA is formed from a reaction product of a fatty acid and an aminoalcohol obtaining mixtures of mono-, di-, and, in one embodiment, triester compounds. In aspects, the FSA comprises one or more softener quaternary ammonium compounds such, but not limited to, as a monoalkylquaternary ammonium compound, dialkylquaternary ammonium compound, a diamido quaternary compound, a diester quaternary ammonium compound, a monoester quaternary ammonium compound or a combination thereof.

In some aspects, the FSA comprises a quaternary ammonium compound selected from the group consisting of:

a) linear quaternary ammonium compounds;

b) branched quaternary ammonium compounds;

c) cyclic quaternary ammonium compounds;

d) and mixtures thereof;

where the quaternary ammonium compounds comprise:

one or more $C_{10}$-$C_{22}$ fatty acid moieties, $C_{16}$-$C_{20}$ fatty acid moieties, or $C_{16}$-$C_{18}$ fatty acid moieties, said fatty acid moieties having an Iodine Value from 0 to about 95, preferably from 0 to about 35, preferably from 0 to about 20;

a counter ion; and one or more moieties selected from the group consisting of alkyl moieties, ester moieties, amide moieties, and ether moieties said one or more moieties being covalently bound to the nitrogen of said quaternary ammonium compound.

The Iodine Value (IV) is the amount of iodine in grams consumed by the reaction of the double bonds of 100 g of fatty acid, determined by the method of ISO 3961.

Exemplary quaternary ammonium compounds include, but are not limited to, alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. Examples of fabric softener actives are described in U.S. Pat. No. 7,381,697, column 3, line 43—column 4, line 67, and in U.S. Pat. No. 7,135,451, column 5, line 1—column 11, line 40, and US 2011/0239377 A1. See also U.S. Pat. Nos. 4,424,134; 4,767,547; 5,545,340; 5,545,350; 5,562,849; and 5,574,179.

It will be understood that combinations of softening actives disclosed above are suitable for use in this invention.

Anion A—In the cationic nitrogenous salts described herein, the anion $A^-$, which comprises any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. In one aspect, the anion A may comprise chloride or methylsulfate. The anion, in some aspects, may carry a double charge. In this aspect, $A^-$ represents half a group.

In some aspects, the fabric softening active comprises a silicone, as described above. Preferred silicones include polydimethylsilicone (PDMS), aminosilicone, silicone polyether, cationic silicones, silicone polyurethane, silicone polyureas, or mixtures thereof and mixtures thereof.

The softener compositions described herein may comprise softener adjuncts. The softener composition may comprise a softener adjunct selected from a salt, a cationic polymer, perfume and/or a perfume delivery system (such as encapsulated perfume), another softener adjunct ingredient listed herein, or mixtures thereof.

Suitable commercially available fabric softeners may also be used, such those sold under the brand names DOWNY®, LENOR® (both available from The Procter & Gamble Company), and SNUGGLE® (available from The Sun Products Corporation).

Additionally, the detergent and softening compositions of the present disclosure may be used in known methods where a surface is treated/washed by hand.

Multi-Component Fabric Treatment System

In some aspects, the present disclosure relates to a multi-component fabric treatment system, where the system comprises a first component comprising a detergent composition as described herein, and where the system further comprises a second component comprising a softener composition as described herein.

In some aspects, the first component further comprises a first container that contains the detergent composition. In some aspects, the second component further comprises a second container that contains the softener composition. The first and second containers may be of any suitable type, for example, bottles, boxes, pouches, or compartments of a multi-compartmented pouch. In some aspects, the pouches may be water soluble and may be formed of water-soluble film, such as polyvinyl alcohol (PVA) film. Preferred films are those supplied by Monosol under the trade references M8630, M8900, M8779, M9467, M8310, films described in U.S. Pat. Nos. 6,166,117, 6,787,512, USPA 2011/0188784, and PVA films of corresponding solubility and deformability characteristics. Further preferred films are those described in US 2006/0213801, WO 2010/119022, and U.S. Pat. No. 6,787,512.

In some aspects, the first component and the second component are proximal to each other. As used herein, "proximal" is understood to mean physically near, for example, separated by no more than about 100 centimeters, or by no more than about 50 centimeters, or by no more than about 10 centimeters, or by no more than about 2 centimeters, or by no more than 0.1 centimeters (e.g, in contact or nearly in contact with each other). For example, the first component and the second component may be proximal to each other on a shelf or in a display and may form an array. In some aspects, the proximal first and second components are contained in a single package, e.g., in a box or a tub. In some aspects, the first component and the second component are each in the form of unitized dose pouches, which may be packaged together in a single package, such as a tub. In such cases, the first component pouches and the second component pouches preferably comprise a signal, for example differing colors or labels, that allow a consumer to distinguish between the two types of pouches.

In some aspects, the proximal first and second components are connected. For example, the first and second components may be contained in separate parts of a single package, for example in a multi-chambered bottle or a multi-compartmented pouch. In some aspects, the first and second components are contained in a multi-compartmented pouch, where the detergent composition is contained in a first compartment and where the softener composition is contained in a second compartment. In such cases, the first and second compartments may have different rates of dissolution; preferably, the first compartment dissolves faster than the second compartment, thereby releasing the detergent composition before the fabric softener composition is released.

In some aspects, the first and second components are removeably connected; in some aspects, the first and second components, once removed, are able to be reconnected. For example, the first and second components may be connected by common outerwrap, e.g. shrink-wrap. In other embodiments, the system comprises connected first and second components in the form of pouches or sachets that may be physically separated into by a vendor or consumer, for example by tearing along a line of perforation.

The first component and the second component may be complementary to each other. For example, the components may be identical, similar, or related in terms of color, shape, and/or graphics. In some aspects, the first container (or a surface of the first container) may be complementary in shape to the second container (or to a surface of the second container), e.g., the containers can be mated, nested, or give the visual impression of being a single article when adjacent.

Combinations

Specifically contemplated combinations of the disclosure are herein described in the following lettered paragraphs. These combinations are intended to be illustrative in nature and are not intended to be limiting.

A. A liquid detergent composition comprising a surfactant system, encapsulates, and a cationic deposition aid polymer, wherein the detergent composition comprises from about 10% to about 50%, by weight of the detergent composition, of the surfactant system, wherein the surfactant system comprises anionic surfactant and nonionic surfactant present in a weight ratio of from about 1:1 to about 4.5:1, wherein the anionic surfactant comprises an anionic sulphate surfactant and an anionic sulphonate surfactant in a weight ratio of from about 1:1 to about 20:1, wherein the detergent composition comprises from about 0.1% to about 5%, by weight of the detergent composition, of the encapsulates, wherein the encapsulates comprise a core and a wall at least partially surrounding the core, wherein the core comprises a benefit agent, wherein the cationic deposition aid polymer is a non-polysaccharide polymer and is characterized by a weight average molecular weight of from about 5 to about 200 kDaltons, and wherein the liquid detergent composition contains, if any, no more than 0.3% of a silicone.

B. A liquid detergent composition according to paragraph A, wherein the surfactant system comprises anionic surfactant and nonionic surfactant present in a weight ratio of from about 2:1 to about 4.5:1, preferably from about 2:1 to about 3:1.

C. A liquid detergent composition according to any of paragraphs A-B, wherein the anionic surfactant comprises the anionic sulphate surfactant and the anionic sulphonate surfactant present in a weight ratio of from about 1:1 to about 10:1, preferably from about 1:1 to about 5:1, more preferably from about 2.5:1.

D. A liquid detergent composition according to any of paragraphs A-C, wherein the detergent composition comprises from about 0.01% to about 2%, or to about 1.5%, or to about 1%, or to about 0.75%, or to about 0.5%, or to about 0.3%, or from about 0.05% to about 0.25%, by weight of the detergent composition, of the cationic deposition aid polymer.

E. A liquid detergent composition according to any of paragraphs A-D, wherein the cationic deposition aid polymer is characterized by a weight average molecular weight of from about 15 to about 50 kDaltons, or from about 18 to about 30 kDaltons.

F. A liquid detergent composition according to any of paragraphs A-E, wherein the cationic deposition aid polymer comprises from about 30 mol % to about 100 mol %, or from about 50 mol % to about 100 mol %, or from about 55 mol % to about 95 mol %, or from about 70 mol % to about 85 mol %, of a cationic structural unit.

G. A liquid detergent composition according to any of paragraphs A-F, wherein the cationic deposition aid polymer comprises a cationic structural unit derived from a cationic monomer selected from the group consisting of quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

H. A liquid detergent composition according to any of paragraphs A-G, wherein the cationic monomer is selected from the group consisting of diallyl dimethyl ammonium salts (DADMAS), quaternized N,N-dimethyl aminoethyl acrylate, quaternized N,N-dimethyl aminoethyl methacrylate (DMAM), [2-(methacryloylamino)ethyl]tri-methylammonium salts, quaternized N,N-dimethylaminopropyl acrylamide (DMAPA), quaternized N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

I. A liquid detergent composition according to any of paragraphs A-H, wherein the cationic monomer is selected from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof.

J. A liquid detergent composition according to any of paragraphs A-I, wherein the cationic monomer is selected from salts of DADMAS, APTAS, and/or MAPTAS, wherein the salts optionally comprise chloride.

K. A liquid detergent composition according to any of paragraphs A-J, wherein the cationic monomer comprises a diallyl dimethyl ammonium salt, preferably diallyl dimethyl ammonium chloride.

L. A liquid detergent composition according to any of paragraphs A-K, wherein the cationic deposition aid polymer comprises a nonionic structural unit.

M. A liquid detergent composition according to any of paragraphs A-L, wherein the cationic polymer comprises from about 5 mol % to about 60 mol %, or from about 15 mol % to about 40 mol %, of a nonionic structural unit.

N. A liquid detergent composition according to any of paragraphs A-M, wherein the cationic polymer comprises a nonionic structural unit derived from a monomer selected from the group consisting of (meth)acrylamide, vinyl formamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

O. A liquid detergent composition according to any of paragraphs A-N, wherein the nonionic structural unit is derived from (meth)acrylamide.

P. A liquid detergent composition according to any of paragraphs A-O, wherein the cationic polymer is selected from the group consisting of acrylamide/DADMAS, acrylamide/DADMAS/acrylic acid, acrylamide/APTAS, acrylamide/MAPTAS, acrylamide/QVi, polyvinyl formamide/DADMAS, poly(DADMAS), acrylamide/MAPTAS/acrylic acid, acrylamide/APTAS/acrylic acid, and mixtures thereof.

Q. A liquid detergent composition according to any of paragraphs A-P, wherein the cationic polymer comprises acrylamide/DADMAS.

R. A liquid detergent composition according to any of paragraphs A-Q, wherein the cationic deposition aid polymer is further characterized by having a calculated cationic charge density of from about 2 meq/g to about 12 meq/g, preferably from about 4.5 to about 7 meq/g.

S. A liquid detergent composition according to any of paragraphs A-R, wherein the composition comprises from about 0.1% to about 1% of the encapsulates.

T. A liquid detergent composition according to any of paragraphs A-S, wherein the benefit agent comprises perfume raw materials.

U. A liquid detergent composition according to any of paragraphs A-T, wherein the walls of the encapsulates comprise a coating on an outer surface of the walls.

V. A liquid detergent composition according to any of paragraphs A-U, wherein the coating comprises a cationic efficiency polymer, preferably a cationic efficiency polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof, and wherein the cationic efficiency polymer is different from the cationic deposition aid polymer.

W. A liquid detergent composition according to any of paragraphs A-V, wherein the coating comprises a cationic efficiency polymer selected from polyvinyl amines, polyvinyl formamides, polyallyl amines, copolymers thereof, and mixtures thereof, preferably polyvinyl formamide, and wherein the cationic efficiency polymer is different from the cationic deposition aid polymer.

X. A liquid detergent composition according to any of paragraphs A-W, wherein the wall comprises a wall material selected from the group consisting of aminoplast copolymer, an acrylic, an acrylate, and mixtures thereof.

Y. A liquid detergent composition according to any of paragraphs A-X, wherein the wall material comprises an aminoplast copolymer, preferably an aminoplast copolymer selected from melamine-formaldehyde, urea-formaldehyde, cross-linked melamine formaldehyde, or mixtures thereof.

Z. A liquid detergent composition according to any of paragraphs A-Y, wherein the composition further comprises an external structurant.

AA. A liquid detergent composition according to any of paragraphs A-Z, wherein the composition further comprises a fatty acid or salt thereof, preferably present in an amount of from about 0.1% to about 4% by weight of the composition.

BB. A liquid detergent composition according to any of paragraphs A-AA, wherein the composition further comprises an adjunct selected from an enzyme, a brightener, a cleaning polymer, a soil release polymer, a polyetheramine, an amine, a hueing dye, or combinations thereof.

CC. A liquid detergent composition according to any of paragraphs A-BB, wherein the composition comprises enzymes, wherein the enzymes comprise cellulase.

DD. A method of treating a fabric, said method comprising a washing step, wherein said washing step comprising contacting a fabric with a detergent composition according to to any of paragraphs A-CC.

EE. A method according paragraph DD, wherein said method of treating a fabric further comprises a softening step, wherein said softening step comprises contacting the fabric with a softening composition.

FF. A liquid detergent composition comprising a surfactant system, encapsulates, and a cationic deposition aid polymer, wherein the detergent composition comprises from about 10% to about 30%, by weight of the detergent composition, of the surfactant system, wherein the surfactant system comprises anionic surfactant and nonionic surfactant present in a weight ratio of from about 1:1 to about 3.8:1, wherein the detergent composition comprises from about 0.1% to about 5%, by weight of the detergent composition, of the encapsulates, wherein the encapsulates comprise a core and a wall at least partially surrounding the core, wherein the core comprises a benefit agent, wherein the cationic deposition aid polymer is a non-polysaccharide polymer and is characterized by a weight average molecular weight of from about 15 to about 50 kDaltons, wherein the cationic deposition aid polymer comprises a cationic structural unit derived from a cationic monomer selected from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof, and wherein the cationic deposition aid polymer further comprises a nonionic structural unit derived from (meth)acrylamide, wherein the cationic structural unit and the nonionic structural unit are present in the cationic deposition aid polymer in a molar ratio of from about 60:40 to about 85:15, and wherein the liquid detergent composition contains, if any, no more than 0.3% of a silicone.

GG. A liquid detergent composition according to any of paragraphs A-FF, wherein the cationic monomer is a diallyl dimethyl ammonium salt (DADMAS), preferably diallyl dimethyl ammonium chloride (DADMAC).

HH. A liquid detergent composition according to any of paragraphs A-GG, wherein cationic polymer comprises from about 55 mol % to about 95 mol %, or from about 60 mol % to about 90 mol %, or from about 70 mol % to about 85 mol %, of the cationic structural unit.

Test Methods

Determining Weight Average Molecular Weight

The weight-average molecular weight (Mw) of a polymer material of the present invention is determined by Size Exclusion Chromatography (SEC) with differential refractive index detection (RI). One suitable instrument is Agilent® GPC-MDS System using Agilent® GPC/SEC software, Version 1.2 (Agilent, Santa Clara, USA). SEC separation is carried out using three hydrophilic hydroxylation polymethyl methacrylate gel columns (Ultrahydrogel 2000-250-120 manufactured by Waters, Milford, USA) directly joined to each other in a linear series and a solution of 0.1M sodium chloride and 0.3% trifluoroacetic acid in DI-water, which is filtered through 0.22 m pore size GVWP membrane filter (MILLIPORE, Massachusetts, USA). The RI detector needs to be kept at a constant temperature of about 5-10° C. above the ambient temperature to avoid baseline drift. It is set to 35° C. The injection volume for the SEC is 100 μL. Flow rate is set to 0.8 mL/min. Calculations and calibrations for the test polymer measurements are conducted against a set of 10 narrowly distributed Poly(2-vinylpyridin) standards from Polymer Standard Service (PSS, Mainz Germany) with peak molecular weights of: Mp=1110 g/mol; Mp=3140 g/mol; Mp=4810 g/mol; Mp=11.5 k g/mol; Mp=22 k g/mol; Mp=42.8 k g/mol; Mp=118 k g/mol; Mp=256 k g/mol; Mp=446 k g/mol; and Mp=1060 k g/mol.

Each test sample is prepared by dissolving the concentrated polymer solution into the above-described solution of 0.1M sodium chloride and 0.3% trifluoroacetic acid in DI water, to yield a test sample having a polymer concentration of 1 to 2 mg/mL. The sample solution is allowed to stand for 12 hours to fully dissolve, and then stirred well and filtered through a 0.45 am pore size nylon membrane (manufactured by WHATMAN, UK) into an auto sampler vial using a 5 mL syringe. Samples of the polymer standards are prepared in a similar manner. Two sample solutions are prepared for each test polymer. Each solution is measured once. The two measurement results are averaged to calculate the Mw of the test polymer.

For each measurement, the solution of 0.1M sodium chloride and 0.3% trifluoroacetic acid in DI water is first injected onto the column as the background. A correction sample (a solution of 1 mg/mL polyethylene oxide with Mp=111.3 k g/mol) is analysed six times prior to other sample measurements, so as to verify repeatability and accuracy of the system.

The weight-average molecular weight (Mw) of the test sample polymer is calculated using the software that accompanies the instrument and selecting the menu options appropriate for narrow standard calibration modelling. A third-order polynomial curve is used to fit the calibration curve to the data points measured from the Poly(2-vinylpyridin) standards. The data regions used for calculating the weight-average molecular weight are selected based upon the strength of the signals detected by the RI detector. Data regions where the RI signals are greater than 3 times the respective baseline noise levels are selected and included in the Mw calculations. All other data regions are discarded and excluded from the Mw calculations. For those regions which fall outside of the calibration range, the calibration curve is extrapolated for the Mw calculation.

To measure the average molecular weight of a test sample containing a mixture of polymers of different molecular weights, the selected data region is cut into a number of equally spaced slices. The height or Y-value of each slice from the selected region represents the abundance (Ni) of a specific polymer (i), and the X-value of each slice from the selected region represents the molecular weight (Mi) of the specific polymer (i). The weight average molecular weight (Mw) of the test sample is then calculated based on the equation described hereinabove, i.e., Mw=(Σi Ni Mi2)/(Σi Ni Mi).

Fabric Treatment Method

Before testing for encapsulate headspace, the test fabrics are prepared and treated according to one of the procedures described below. Fabrics are typically "de-sized" and/or "stripped" of any manufacturer's finish that may be present (according to A, below), dried, and then treated with a detergent composition in either a top-loading machine or a front-loading machine (according to B1 or B2, below).

A. Fabric Preparation Method. Fabrics may be prepared according to one or both of the following methods.

A1. Fabric De-sizing Method. New fabrics are de-sized by washing two cycles at 49° C. (120° F.), using zero grain water in a top loading washing machine such as Kenmore 80 series. All fabrics are tumble-dried after the second cycle for 45 minutes on cotton/high setting in a Kenmore series dryer.

A2. Fabric Pre-conditioning Method. De-sized fabrics are pre-conditioned with detergent and liquid fabric softener by washing for 3 cycles at 32° C. using 6 grain per gallon water in a top loading washing machine such as Kenmore 80 series. The detergent (Tide®, 50 g) is added to the drum of the washing machine after the water has filled at the beginning of the wash cycle, followed by 2.5 kg of de-sized 100% cotton terry towels (30.5 cm×30.5 cm, RN37000-ITL available from Calderon Textiles, LLC 6131 W 80th St Indianapolis Ind. 46278). Liquid fabric softener (Downy®, 25.5 g) is added to the drum during the rinse cycle once the rinse water has filled. All fabrics are tumble-dried after the second cycle for 45 minutes on cotton/high setting in a Kenmore series dryer.

B. Fabric Treatment Method. Fabrics may be treated according to any of the following methods.

B1. Fabric Treatment with Detergent in a Top Loading Washing Machine. De-sized fabrics are treated with a detergent composition using the standard wash setting on a top-loading National NA-FV8100 washing machine. The machine uses a 49 L fill volume with a 12 minute wash cycle, 2 rinse cycles, and 1-3 min spin cycle using 27° C. (81° F.) water for the wash and rinse cycles. The wash and rinse cycles use 6 grain per gallon water. The detergent composition (52.5 g) is added to the washing machine drum after the water is filled at the beginning of the wash cycle. Then, 2.9 kg of de-sized 100% cotton terry towels (30.5 cm×30.5 cm, RN37000-ITL available from Calderon Textiles, LLC 6131 W 80th St Indianapolis Ind. 46278) are added to the drum of the machine. Treated fabrics are dried in a constant temperature and humidity room at 50% RH and 21° C. (70° F.) for 22-26 h.

B2. Fabric Treatment with Detergent and Fabric Softener in a Top Loading Washing Machine. De-sized fabrics (prepared according to A1) are treated with a detergent composition using the standard wash setting on a top-loading National NA-FV8100 washing machine as described in B1 and Liquid Fabric Softener is added via the machine dispenser (Lenor®, 23 g). Treated fabrics are dried in a constant temperature and humidity room at 50% RH and 21° C. (70° F.) for 22-26 h. Fabrics are washed and dried for a total of 3 cycles.

B3. Fabric Treatment with Detergent in a Top Loading Machine. De-sized and pre-conditioned fabrics (prepared according to A1 and A2) are treated with a detergent composition by dispensing the detergent composition into the wash cycle of a top-loading washing machine such as a Kenmore 80 series. The detergent composition (50 g) is added to the drum of the washing machine, and 2.5 kg of de-sized 100% cotton terry towels (32 cm×32 cm, such as RN37002LL from Calderon Textiles, Indianapolis, Ind., USA) are added to the drum of the machine. The de-sized fabrics are treated with a detergent composition using the normal cycle with 64.4 L of water with 6 grain per gallon water and 32° C. wash temperature and 16° C. rinse temperature. Treated fabrics are dried using a standard US tumble dryer such as Kenmore series dryer on the cotton/high setting for 45 minutes.

Olfactive Performance Method

To evaluate the scent intensity of treated fabrics, the Olfactive Performance Method as described herein may be used. In sum, the treated fabrics are smelled by a trained grader panel where each panelist is given a separate fabric from the fabric treatment method to evaluate for scent intensity. The trained panel is comprised of 20 qualified panelists that grade the fabrics for scent intensity using Dry Fabric Odor (DFO) and Rubbed Fabric Odor (RFO) intensity scores on a scale of 0-100 where a "0" score means there is no scent or fragrance on the fabric, a "50" score means there is a moderate scent or fragrance intensity on the fabrics, and a "100" score means there is a high scent or intensity on fabrics (ie. a score of 100 has the strongest odor). The panelists are qualified after correctly detecting the appropriate intensity in neat perfume solutions, and correctly detecting the intensity trends in treated fabrics. The panelists must correctly rank order the perfume solution intensity of 0.5%, 2%, and 5% perfume solutions in dipropylene glycol in three out of 4 assessments.

Panelist scores are anchored using untreated fabrics as baseline (0 score), and perfume anchors representing scent strength scores of low (10-30), medium (40-70) and high intensity (80-100). Anchors are made using neat perfume in a water/ethanol base (95%/5%). Neat perfume (15 g) is mixed with Aquasolve (85 g) to solubilize the perfume, then the perfume/Aquasolve mixture is added to the water/ethanol base at different concentrations representing low (0.03% perfume), medium (0.09%), and high (0.27%) intensity levels of the scale. The anchor level solutions are applied to cotton swabs or filter paper strips 15 min before the panel begins. The panelists sniff the swabs to anchor themselves to the intensity scale in the panel.

The treated fabrics are equilibrated at 21° C./50% relative humidity for a minimum of 12 h before the evaluation. The panel is run in a 21° C./50% relative humidity controlled room, and test fabrics are equilibrated for 30 min in the panel room before evaluation. Each panelist smells an individual treated fabric and records the DFO. The same fabric is rubbed together 6 times, and the panelist smells the fabric again and records the RFO. The score from 20 different treated fabrics are averaged. Panelists smell five different treatment legs, and treatments are randomized between panelists. Each panel includes a reference treatment, and intensity differences are relative to this reference. The higher the averaged score for DFO and RFO, the more intense the scent is on fabrics.

Clay Stain Removal Method

Technical stain swatches of CW120 cotton containing Black Todd clay (available from Accurate Product Development, Fairfield, Ohio), and US Clay (available from from Empirical Manufacturing Company, Cincinnati, Ohio) are treated with a detergent composition of the present invention using the standard wash setting on a top-loading Kenmore 80 series washing machine. The machine uses a 64 L fill volume with 32° C. (81° F.) water for the wash and 16° C. water rinse cycles. The wash and rinse cycles use 6 grain per gallon water. The detergent composition (46.5 g) is added to the washing machine drum after the water is filled at the beginning of the wash cycle, and then two, CW120 stain swatches plus 2.9 kg of de-sized fabric ballast are added to the drum. The de-sized ballast is comprised of approximately 50% by weight of 100% cotton T-shirts (Gildan T-shirts, TCS Apparel), 25% by weight of 50% polyester/50% cotton pillowcases (Standard Textile Company) and 25% by weight of 86% cotton/14% polyester terry towels (Standard Textile Company). A total of eight stain swatches are averaged from 2 internal replicates from 4 different wash cycles for a total of eight CW120 swatches. Treated fabrics are dried in a cotton/high setting in a Kenmore series dryer.

Standard colorimetric measurement was used to obtain L*, a* and b* values for each stain before and after the washing. From L*, a* and b* values, the stain level was calculated by comparing the initial stain level before washing to the stain level after washing and accounting for the initial background corresponding to an unstained portion of the fabric.

Stain removal from the swatches was measured as follows:

$$\text{Stain Removal Index } (SRI) = \frac{\Delta E_{initial} - \Delta E_{washed}}{\Delta E_{initial}} \times 100$$

$\Delta E_{initial}$=Stain level before washing−Unstained, unwashed portion of fabric $\Delta E_{washed}$=Stain level after washing−Unstained, unwashed portion of fabric The SRI values are the averaged SRI values from the eight replicates. The stain level of the fabric before the washing ($\Delta E_{initial}$) is high; in the washing process, stains are removed and the stain level after washing is reduced ($\Delta E_{washed}$). The better a stain has been removed, the lesser the value for $\Delta E_{washed}$ and the greater the difference between $\Delta E_{initial}$ and $\Delta E_{washed}$ ($\Delta E_{initial} - \Delta E_{washed}$). Therefore the value of the stain removal index increases with better washing performance.

EXAMPLES

The non-limiting examples given below illustrate compositions according to the present disclosure.

Example 1—Exemplary Formulations and Effect of Deposition Aid Selection on Perfume Benefits A. Formulations. Liquid detergent compositions are prepared by mixing the ingredients listed in the proportions shown in Table 1. Each composition contains coated encapsulates that contained perfume raw materials. Formulations 1A, 1B, 1D, and 1E are comparative formulations.

TABLE 1

| Ingredient (wt %) | 1A (comp) | 1B (comp) | 1C | 1D (comp) | 1E (comp) | 1F | 1G |
|---|---|---|---|---|---|---|---|
| Sulphate surfactant [$C_{12}$-$C_{14}$ alkyl polyethoxylate (3) sulfate ("AES")] | 4.1 | 4.1 | 4.1 | 6.36 | 6.36 | 6.36 | 5.2 |
| Sulphonate surfactant [$C_{11.8}$ linear alkylbenzene sulfonc acid ("LAS")] | 4.1 | 4.1 | 4.1 | 2.59 | 2.59 | 2.59 | 5.2 |
| Nonionic surfactant ($C_{12}$-$C_{14}$ branched alcohol-7 ethoxylate | 4.1 | 4.1 | 4.1 | 3.29 | 3.29 | 3.29 | 5.2 |

TABLE 1-continued

| Ingredient (wt %) | 1A (comp) | 1B (comp) | 1C | 1D (comp) | 1E (comp) | 1F | 1G |
|---|---|---|---|---|---|---|---|
| Additional anionic surfactant ($C_{12}$-$C_{18}$ Fatty Acid) | 3.61 | 3.61 | 3.61 | 3.61 | 3.61 | 3.61 | — |
| Dodecyltrimethyl ammonium chloride (cationic surfactant) | 0.62 | 0.62 | 0.62 | 0.62 | 0.62 | 0.62 | 0.62 |
| Ratio of sulfate:sulphonate (AES:LAS) | 1:1 | 1:1 | 1:1 | 2.5:1 | 2.5:1 | 2.5:1 | 1:1 |
| Ratio of anionic:non-ionic (note: fatty acid is included as anionic) | 2.9:1 | 2.9:1 | 2.9:1 | 3.8:1 | 3.8:1 | 3.8:1 | 2:1 |
| Na Cumene Sulfonate | 1.30 | 1.30 | 1.30 | 1.30 | 1.30 | 1.30 | 1.30 |
| Citric acid | 1.23 | 1.23 | 1.23 | 1.23 | 1.23 | 1.23 | 1.23 |
| Sodium tetraborate premix (15% active) | 0.90 | 0.90 | 0.90 | 0.90 | 0.90 | 0.90 | 0.90 |
| Enzymes | 0.011 | 0.011 | 0.011 | 0.011 | 0.011 | 0.011 | 0.011 |
| Chelant | 0.22 | 0.22 | 0.22 | 0.22 | 0.22 | 0.22 | 0.22 |
| Cleaning polymer[1,2] | 0.27 | 0.27 | 0.27 | 0.27 | 0.27 | 0.27 | 0.27 |
| Hydrogenated castor oil[3] | 0.13 | 0.13 | 0.13 | 0.13 | 0.13 | 0.13 | 0.13 |
| Encapsulates[4] | 0.18 | 0.18 | 0.18 | 0.18 | 0.18 | 0.18 | 0.18 |
| Deposition Aid | — | 0.16[5] | 0.16[6] | — | 0.16[5] | 0.16[6] | 0.16[6] |
| Organosiloxane polymer (anti-foam agent)[7] | 0.002 | 0.002 | 0.002 | 0.002 | 0.002 | 0.002 | 0.002 |
| Water, perfumes, dyes, buffers, solvents and other optional components | to 100% pH 7.7-8.2 | to 100% pH 7.7-8.2 | to 100% pH 7.7-8.2 | to 100% pH 7.7-8.2 | to 100% pH 7.7-8.2 | to 100% pH 7.7-8.2 | to 100% pH 7.7-8.2 |

[1]Available from BASF (Ludwigshafen, Germany)

[2]600 g/mol molecular weight polyethylenimine core with 20 ethoxylate groups per —NH and available from BASF (Ludwigshafen, Germany)

[3]Available under the tradename ThixinR from Elementis Specialties, Highstown, NJ

[4]Aminoplast perfume accord encapsulates with poly(vinylformamide coating) available from Encapsys, Appleton, WI

[5]Cationic hydroxyethoxylated cellulose; MW = approx. 400 kDaltons

[6]Cationic copolymer having acrylamide and DADMAC structural units in an approx. 30:70 molar percentage ratio; MW = approx. 19 kDaltons

[7]Available from Dow Corning, Midland, MI

B. Olfactive Assessment. Fabrics (100% cotton terry towels) were prepared and treated according to the Fabric Treatment method B2, above, with Formulations 1A, 1B, 1C, 1E, and 1F, respectively, found in Table 1. The dry fabrics were then analyzed according to the Olfactive Performance Method given above, with the Rubbed Fabric Odor (RFO) results shown in Table 2.

TABLE 2

| Formulation | Ratio of AES:LAS | Ratio of anionic:non-ionic surfactant | Cationic Deposition Aid | Rubbed Fabric Odor (RFO) | Increase in RFO vs. Ref. |
|---|---|---|---|---|---|
| 1E (comp.) | 2.5:1 | 3.8:1 | Polysaccharide[1] | 66 | Reference |
| 1F | 2.5:1 | 3.8:1 | Aam/DADMAC[2] | 73 | +7 |
| 1B (comp.) | 1:1 | 2.9:1 | Polysaccharide[1] | 72 | +6 |
| 1C | 1:1 | 2.9:1 | Aam/DADMAC[2] | 77 | +11 |

[1]Cationic hydroxyethoxylated cellulose; MW = approx. 400 kDaltons

[2]Cationic copolymer having acrylamide and DADMAC structural units in an approx. 30:70 molar percentage ratio; MW = approx. 19 kDaltons As can be seen by comparing Rubbed Fabric Odor results from Formulations 1E and 1F, a composition that includes a cationic deposition aid according to the present disclosure provides improved perfume benefits compared to a comparative composition that includes a polysaccharide deposition aid polymer. Further, as can be seen by the results from Formulations 1B, and 1C, perfume benefits can be further improved by combining the cationic deposition aid of the present disclosure with an anionic to non-ionic surfactant ratio of 2.9:1.

Example 2—Exemplary Formulations and Effect of Deposition Aid Selection on Clay Removal A. Formulations. Liquid detergent compositions are prepared by mixing the ingredients listed in the proportions shown in Table 3. Each composition contains coated encapsulates that contained perfume raw materials. Formulations 2B and 2E are comparative formulations.

TABLE 3

| Ingredient (wt %) | 2A | 2B (comp) | 2C | 2D | 2E (comp) |
|---|---|---|---|---|---|
| Sulphate surfactant [$C_{12}$-$C_{14}$ alkyl polyethoxylate (3) sulfate ("AES")] | 4.8 | 4.8 | 4.8 | 7.7 | 7.7 |
| Sulphonate surfactant [$C_{11.8}$ linear alkylbenzene sulfonc acid ("LAS")] | 4.8 | 4.8 | 4.8 | 3.1 | 3.1 |
| Nonionic surfactant ($C_{12}$-$C_{14}$ branched alcohol-7 ethoxylate) | 4.8 | 4.8 | 4.8 | 4.0 | 4.0 |
| Additional anionic surfactant ($C_{12}$-$C_{18}$ Fatty Acid) | 1.8 | 1.8 | 4.3 | 4.3 | 4.3 |
| Dodecyltrimethyl ammonium chloride (cationic surfactant) | 0.62 | 0.62 | 0.62 | 0.62 | 0.62 |
| Ratio of sulphate/sulfonate (AES:LAS) | 1:1 | 1:1 | 1:1 | 2.5:1 | 2.5:1 |
| Ratio of anionic:non-ionic surfactant (note:anionic includes fatty acids) | 2:1 | 2:1 | 2:1 | 2.7:1 | 2.7:1 |
| Na Cumene Sulfonate | 1.30 | 1.30 | 1.30 | 1.30 | 1.30 |
| Citric acid | 1.23 | 1.23 | 1.23 | 1.23 | 1.23 |
| Sodium tetraborate premix | 0.90 | 0.90 | 0.90 | 0.90 | 0.90 |
| Enzymes | 0.011 | 0.011 | 0.011 | 0.011 | 0.011 |
| Chelant | 0.22 | 0.22 | 0.22 | 0.22 | 0.22 |
| Cleaning polymer[1,2] | 0.27 | 0.27 | 0.27 | 0.27 | 0.27 |
| Hydrogenated castor oil[3] | 0.13 | 0.13 | 0.13 | 0.13 | 0.13 |
| Encapsulated Perfume[4] | 0.18 | 0.18 | 0.18 | 0.18 | 0.18 |
| Deposition Aid | 0.16[6] | 0.16[8] | 0.16[6] | 0.16[6] | 0.16[5] |
| Organosiloxane polymer (anti-foam agent)[5] | 0.002 | 0.002 | 0.002 | 0.002 | 0.002 |
| Water, perfumes, dyes, buffers, solvents and other optional components | to 100% pH 7.7-8.2 | to 100% pH 7.7-8.2 | to 100% pH 7.7-8.2 | to 100% pH 7.7-8.2 | to 100% pH 7.7-8.2 |

[1]Available from BASF (Ludwigshafen, Germany)
[2]600 g/mol molecular weight polyethylenimine core with 20 ethoxylate groups per —NH and available from BASF (Ludwigshafen, Germany)
[3]Available under the tradename ThixinR from Elementis Specialties, Highstown, NJ
[4]Aminoplast perfume accord encapsulates with poly(vinylformamide coating) available from Encapsys, Appleton, WI
[5]Cationic hydroxyethoxylated cellulose; MW = approx. 400 kDaltons
[6]Cationic copolymer having acrylamide and DADMAC structural units in an approx. 30:70 molar percentage ratio; MW = approx. 19 kDaltons
[7]Available from Dow Corning, Midland, MI
[8]Cationic copolymer having acrylamide and MAPTAC structural units in an approx.. 88:12 molar percentage ratio; MW = approx. 1100 kDaltons B. Clay Removal Analysis. Fabrics (100% cotton) were treated with Formulations 2A, 2B, 2D, and 2E, respectively, found in Table 3 according to the Clay Stain Removal method described above. The fabrics were then analyzed for Black Todd Clay stain removal according to the test method given above, with the results shown in Tables 4 and 5.

TABLE 4

| Formulation | Ratio of AES:LAS | Ratio of anionic:non-ionic surfactant | Deposition Aid Polymer | Black Todd Clay Stain Removal compared to nil-polymer control (LSD: 2.5) |
|---|---|---|---|---|
| 2A | 1:1 | 2:1 | Aam/DADMAC[1] | +4 |
| 2B (comp) | 1:1 | 2:1 | Aam/MAPTAC[2] | −15 |

[1]Cationic copolymer having acrylamide and DADMAC structural units in an approx.. 30:70 molar percentage ratio; MW = approx. 19 kDaltons
[2]Cationic copolymer having acrylamide and MAPTAC structural units in an approx.. 88:12 molar percentage ratio; MW = approx. 1100 kDaltons As can be seen from the results shown in Table 4, a composition according to the present disclosure provides significantly better results on Black Todd Clay stain removal compared to a nil-polymer control composition. Additionally, Table 4 also shows that the comparative composition performs significantly worse on Black Todd Clay stain removal compared to the nil-polymer control composition.

TABLE 5

| Formulation | Ratio of AES:LAS | Ratio of anionic:non-ionic surfactant | Deposition Aid Polymer | Black Todd Clay Stain Removal compared to nil-polymer control (LSD 2.97) | Difference in Black Todd Clay Stain Removal between |
|---|---|---|---|---|---|
| 2D | 2.5:1 | 2.7:1 | Aam/DADMAC[1] | +2 | 2D and 2E |
| 2E (comp) | 2.5:1 | 2.7:1 | Polysaccharide[2] | −3 | 5 |

[1]Cationic copolymer having acrylamide and DADMAC structural units in an approx. 30:70 molar percentage ratio; MW = approx. 19 kDaltons
[2]Cationic hydroxyethoxylated cellulose; MW = approx. 400 kDaltons As can be seen from the results shown in Table 5, a composition according to the present disclosure provides significantly better results on Black Todd Clay stain removal compared to a comparative composition that includes a cationic polysaccharide.

Example 3—Exemplary Formulations and Effect of Deposition Aid Selection on Olfactive Performance and Clay Stain Removal A. Formulations. Liquid detergent compositions are prepared by mixing the ingredients listed in the proportions shown in Table 6. Each composition contains coated encapsulates that contained perfume raw materials. Formulation 3A is a comparative formulation.

TABLE 6

| Ingredient (wt %) | 3A (comp) | 3B | 3C | 3D | 3E | 3F | 3G | 3H |
|---|---|---|---|---|---|---|---|---|
| Sulphate surfactant [$C_{12}$-$C_{15}$ alkyl polyethoxylate (1.8) sulfate ("AES")] | 4.9 | 4.9 | 5.7 | 7.4 | 8.6 | 7.3 | 7.3 | 9.2 |
| Sulphonate surfactant [$C_{11.8}$ linear alkylbenzene sulfonic acid ("LAS")] | 2.4 | 2.4 | 1.9 | 2.1 | 8.5 | 7.3 | 7.3 | 3.7 |
| Nonionic surfactant ($C_{12}$-$C_{14}$ alcohol 9 ethoxylate) | 2.4 | 2.4 | 1.9 | — | 4.5 | 7.3 | 7.3 | 5.8 |
| $C_{12}$-$C_{18}$ Fatty Acid | — | — | — | — | 1.5 | 1 | — | — |
| $C_{12}$ alkyl dimethyl amine oxide | 0.5 | 0.5 | 0.5 | 0.5 | — | — | — | 0.5 |
| Ratio of sulphate/sulphonate (AES:LAS) | 2:1 | 2:1 | 3:1 | 3.5:1 | 1:1 | 1:1 | 1:1 | 2.5:1 |

TABLE 6-continued

| Ingredient (wt %) | 3A (comp) | 3B | 3C | 3D | 3E | 3F | 3G | 3H |
|---|---|---|---|---|---|---|---|---|
| Ratio of anionic:non-ionic surfactant (note: anionic includes fatty acid; nonionic includes amine oxide) | 2.5:1 | 2.5:1 | 3.2:1 | 19:1 | 4.1:1 | 1.7:1 | 1:1 | 2:1 |
| Na Cumene Sulfonate | — | — | — | — | 0.2 | 0.2 | 0.3 | 0.2 |
| Citric acid | 1.05 | 1.05 | 1.05 | 1.05 | 1.3 | 1.26 | 2.3 | 1.26 |
| Sodium tetraborate premix (27% activity) | 1.23 | 1.23 | 1.23 | 1.23 | 1.6 | 1.6 | 1.1 | 1.6 |
| Enzymes | 0.05 | 0.05 | 0.05 | 0.05 | 0.05 | 0.05 | 0.04 | 0.05 |
| Fluorescent Whitening Agent | 0.050 | 0.050 | 0.050 | 0.050 | 0.20 | 0.20 | 0.20 | 0.08 |
| Chelant | 0.3 | 0.3 | 0.3 | 0.3 | 0.5 | 0.5 | 0.5 | 0.2 |
| Cleaning polymers[1, 2, 9] | 0.8 | 0.8 | 0.8 | 0.8 | 3.2 | 3.2 | 3.2 | 2.0 |
| Hydrogenated castor oil[3] | 0.15 | 0.15 | 0.15 | 0.15 | 0.15 | 0.15 | 0.15 | 0.15 |
| Encapsulated perfume[4] | 0.3 | 0.3 | 0.3 | 0.3 | 0.4 | 0.3 | 0.3 | 0.30 |
| Deposition Aid | — | 0.16 | 0.16 | 0.16 | 0.10 | 0.10 | 0.1 | 0.20 |
| Organosiloxane polymer (anti-foam agent)[5] | 0.004 | 0.004 | 0.004 | 0.004 | 0.003 | 0.003 | 0.003 | 0.003 |
| Water, perfumes, dyes, buffers, solvents, chelant and other optional components | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 |

[1]Available from BASF (Ludwigshafen, Germany)

[2]600 g/mol molecular weight polyethylenimine core with 20 ethoxylate groups per —NH and available from BASF (Ludwigshafen, Germany)

[3]Available under the tradename ThixinR from Elementis Specialties, Highstown, NJ

[4]Aminoplast perfume accord encapsulates with poly(vinylformamide coating) available from Encapsys, Appleton, WI

[5]Cationic hydroxyethoxylated cellulose; MW = approx. 400 kDaltons

[6]Cationic copolymer having acrylamide and DADMAC structural units in an approx. 30:70 molar percentage ratio; MW = approx. 19 kDaltons

[7]Available from Dow Corning, Midland, MI

[8]Cationic copolymer having acrylamide and MAPTAC structural units in an approx.. 88:12 molar percentage ratio; MW = approx. 1100 kDaltons

[9]600 g/mol molecular weight polyethylenimine core with 24 ethoxylate groups per —NH and 16 propoxylate groups per —NH. Available from BASF (Ludwigshafen, Germany)

B. Olfactive Assessment. Fabrics (100% cotton terry towels) were prepared and treated according to the Fabric Preparation method B3 above with Formulations 3A, 3B, and 3C, respectively, found in Table 7. The dry fabrics were then analyzed according to the Olfactive Performance Method given above, with the RFO results shown in Table 7.

TABLE 7

| Formulation | Ratio of AES:LAS | Ratio of anionic:non-ionic surfactant | Cationic Deposition Aid | Rubbed Fabric Odor (RFO) | Increase in RFO vs. reference |
|---|---|---|---|---|---|
| 3A (comp) | 2:1 | 2.5:1 | none | 45 | Reference |
| 3B | 2:1 | 2.5:1 | Aam/DADMAC[2] | 51 | +6 |
| 3C | 3:1 | 3.2:1 | Aam/DADMAC[2] | 52 | +7 |

[2]Cationic copolymer having acrylamide and DADMAC structural units in an approx. 30:70 molar percentage ratio; MW = approx. 19 kDaltons As can be seen by comparing Rubbed Fabric Odor results from Formulations 3B and 3C, a composition that includes a synthetic deposition aid according to the present disclosure provides improved perfume benefits compared to a reference composition that includes does not include a cationic deposition aid polymer.

C. Clay Stain Removal. In the following examples, fabrics (100% cotton) were treated with formulation 3E and the deposition aid polymer was varied as shown in Table 8. The fabrics were then analyzed for Black Todd Clay stain removal according to the test method given above with the results shown in Table 8.

TABLE 8

| Formulation | Ratio of AES:LAS | Ratio of anionic:non-ionic surfactant | Deposition Aid Polymer | Black Todd Clay Stain Removal compared to nil-polymer control (LSD: 2.1) |
|---|---|---|---|---|
| 3E-1 | 1:1 | 2:1 | Aam/DADMAC[1] | −0.9 |
| 3E-2 (comp.) | 1:1 | 2:1 | Aam/MAPTAC[2] | −18.5 |

[1]Cationic copolymer having acrylamide and DADMAC structural units in an approx. 30:70 molar percentage ratio; MW = approx. 19 kDaltons
[2]Cationic copolymer having acrylamide and MAPTAC structural units in an approx. 88:12 molar percentage ratio; MW = approx. 1100 kDaltons As shown in Table 8, a comparative composition (3E-2) comprising a comparative cationic polymer performs significantly worse on Black Todd Clay Stain Removal compared to a composition according to the present disclosure that includes a low-molecular-weight cationic polymer according to the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

A) from about 10% to about 50%, by weight of the detergent composition, of a surfactant system, wherein the surfactant system comprises:
  i) an anionic sulphate surfactant;
  ii) an anionic sulphonate surfactant; and
  iii) a nonionic surfactant;
  wherein the anionic sulphate surfactant and the anionic sulphonate surfactant are present in a weight ratio of from about 2:1 to about 3:1, and wherein the ratio of anionic surfactants to nonionic surfactant is present in a ratio of from about 2:1 to about 3:1;

B) from about 0.1% to about 5%, by weight of the detergent composition, of encapsulates, wherein the encapsulates comprise a core and a wall at least partially surrounding the core, wherein the core comprises a benefit agent;

C) a cationic deposition aid polymer, wherein the cationic deposition aid polymer is a non-polysaccharide polymer comprising a cationic structural unit derived from a cationic monomer comprising a diallyl dimethyl ammonium salt, preferably diallyl dimethyl ammonium chloride and has a weight average molecular weight of from about 5 to about 30 kDaltons; and D) a cellulase enzyme;

wherein the liquid detergent composition contains, if any, no more than 0.3% of a silicone.

2. A liquid detergent composition according to claim 1, wherein the detergent composition comprises from about 0.01% to about 2%, or to about 1.5%, or to about 1%, or to about 0.75%, or to about 0.5%, or to about 0.3%, or from about 0.05% to about 0.25%, by weight of the detergent composition, of the cationic deposition aid polymer.

3. A liquid detergent composition according to claim 1, wherein the cationic deposition aid polymer is characterized by a weight average molecular weight of from about 15 to about 30 kDaltons.

4. A liquid detergent composition according to claim 1, wherein the cationic deposition aid polymer comprises from about 30 mol % to about 100 mol %, or from about 50 mol % to about 100 mol %, or from about 55 mol % to about 95 mol %, or from about 70 mol % to about 85 mol %, of a cationic structural unit.

5. A liquid detergent composition according to claim 1, wherein the cationic deposition aid polymer comprises a nonionic structural unit.

6. A liquid detergent composition according to claim 5, wherein the cationic polymer comprises from about 5 mol % to about 60 mol %, or from about 15 mol % to about 40 mol %, of a nonionic structural unit.

7. A liquid detergent composition according to claim 5, wherein the cationic polymer comprises a nonionic structural unit derived from a monomer selected from the group consisting of (meth)acrylamide,vinyl formamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

8. A liquid detergent composition according to claim 7, wherein the nonionic structural unit is derived from (meth) acrylamide.

9. A liquid detergent composition according to claim 1, wherein the cationic polymer is selected from the group consisting of acrylamide/DADMAS, acrylamide/DADMAS/acrylic acid, acrylamide/APTAS, acrylamide/MAPTAS, acrylamide/QVi, polyvinyl formamide/DADMAS, poly(DADMAS), acrylamide/MAPTAS/acrylic acid, acrylamide/APTAS/acrylic acid, and mixtures thereof.

10. A liquid detergent composition according to claim 9, wherein the cationic polymer comprises acrylamide/DADMAS.

11. A liquid detergent composition according to claim 1, wherein the cationic deposition aid polymer is further characterized by having a calculated cationic charge density of from about 2 meq/g to about 12 meq/g, preferably from about 4.5 to about 7 meq/g.

12. A liquid detergent composition according to claim 1, wherein the composition comprises from about 0.1% to about 1% of the encapsulates.

13. A liquid detergent composition according to claim 1, wherein the benefit agent comprises perfume raw materials.

14. A liquid detergent composition according to claim 1, wherein the walls of the encapsulates comprise a coating on an outer surface of the walls.

15. A liquid detergent composition according to claim 14, wherein the coating comprises a cationic efficiency polymer, preferably a cationic efficiency polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof, and wherein the cationic efficiency polymer is different from the cationic deposition aid polymer.

16. A liquid detergent composition according to claim 14, wherein the coating comprises a cationic efficiency polymer selected from the group consisting of polyvinyl amines, polyvinyl formamides, polyallyl amines, copolymers thereof, and mixtures thereof, preferably polyvinyl formamide, and wherein the cationic efficiency polymer is different from the cationic deposition aid polymer.

17. A liquid detergent composition according to claim 1, wherein the wall comprises a wall material selected from the group consisting of aminoplast copolymer, an acrylic, an acrylate, and mixtures thereof.

18. A liquid detergent composition according to claim 17, wherein the wall material comprises an aminoplast copolymer, preferably an aminoplast copolymer selected from melamine-formaldehyde, urea-formaldehyde, cross-linked melamine formaldehyde, or mixtures thereof.

19. A liquid detergent composition according to claim 1, wherein the composition further comprises an external structurant.

20. A liquid detergent composition according to claim 1, wherein the composition further comprises a fatty acid or salt thereof, preferably present in an amount of from about 0.1% to about 4% by weight of the composition.

21. A liquid detergent composition according to claim 1, wherein the composition further comprises an adjunct selected from the group consisting of a brightener, a cleaning polymer, a soil release polymer, a polyetheramine, an amine, a hueing dye, or combinations thereof.

22. A method of treating a fabric, said method comprising a washing step, wherein said washing step comprising contacting a fabric with a detergent composition according to claim 1.

23. A method according to claim 22, wherein said method of treating a fabric further comprises a softening step, wherein said softening step comprises contacting the fabric with a softening composition.

* * * * *